US007326846B2

(12) United States Patent
Terada

(10) Patent No.: US 7,326,846 B2
(45) Date of Patent: Feb. 5, 2008

(54) APPARATUS PROVIDING INFORMATION WITH MUSIC SOUND EFFECT

(75) Inventor: Kosei Terada, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 406 days.

(21) Appl. No.: 10/651,885

(22) Filed: Aug. 29, 2003

(65) Prior Publication Data

US 2004/0055442 A1 Mar. 25, 2004

Related U.S. Application Data

(62) Division of application No. 09/711,972, filed on Nov. 14, 2000, now Pat. No. 6,700,048.

(30) Foreign Application Priority Data

Nov. 19, 1999 (JP) ..... 11-329426

(51) Int. Cl.
*A63H 5/00* (2006.01)
*G04B 13/00* (2006.01)
*G10H 7/00* (2006.01)

(52) U.S. Cl. ..... 84/609; 715/752

(58) Field of Classification Search ..... 84/609, 84/610, 631, 645; 434/307 A; 715/744–747, 715/752

See application file for complete search history.

(56) References Cited

U.S. PATENT DOCUMENTS 5,453,569 A 9/1995 Saito et al.
5,524,193 A 6/1996 Covington et al.
5,736,663 A 4/1998 Aoki et al.
5,860,064 A * 1/1999 Henton ..... 704/260
5,899,975 A * 5/1999 Nielsen ..... 704/270.1
5,983,176 A 11/1999 Hoffert et al.
6,084,169 A 7/2000 Hasegawa et al.
6,175,071 B1 * 1/2001 Ito ..... 84/609

(Continued)

FOREIGN PATENT DOCUMENTS

EP 0 913 783 5/1999

(Continued)

OTHER PUBLICATIONS

EPO Search Report, App. No. 04 104 726.7 - 2218, Mar. 31, 2005.*

(Continued)

*Primary Examiner*—Jeffrey Donels
(74) *Attorney, Agent, or Firm*—Morrison & Foerster LLP

(57) ABSTRACT

An information producing apparatus is constructed for producing a combination of object information providing substantial contents and performance information providing a music piece in association with the substantial contents. In the information producing apparatus, a source section provides the object information having substantial contents. An extracting section analyzes the provided object information to extract therefrom the characteristic information which is characteristic of the substantial contents of the provided object information. An attaching section operates based on the extracted characteristic information for attaching performance information to the provided object information. On the other hand, an information reproducing apparatus utilizes the attached performance information to provide a performance of a music piece as a music effect in association with the substantial contents when reproducing the object information transmitted from the information producing apparatus.

27 Claims, 13 Drawing Sheets

U.S. PATENT DOCUMENTS

| | | | | |
|---|---|---|---|---|
| 6,184,454 | B1 | 2/2001 | Imai et al. | |
| 6,188,010 | B1 | 2/2001 | Iwamura | |
| 6,201,176 | B1 | 3/2001 | Yourlo | |
| 6,263,313 | B1 | 7/2001 | Milsted et al. | |
| 6,294,720 | B1 | 9/2001 | Aoki | |
| 6,307,139 | B1 | 10/2001 | Iwamura | |
| 6,393,107 | B1 * | 5/2002 | Ball et al. | 379/88.13 |
| 2002/0053273 | A1 | 5/2002 | Suzuki et al. | |
| 2002/0191757 | A1 * | 12/2002 | Belrose | 379/88.13 |
| 2002/0193996 | A1 * | 12/2002 | Squibbs et al. | 704/260 |

FOREIGN PATENT DOCUMENTS

| | | |
|---|---|---|
| JP | 10-319950 | 12/1998 |
| JP | 11-203217 | 7/1999 |
| JP | 11-224084 | 8/1999 |
| JP | 2000-039884 | 2/2000 |

OTHER PUBLICATIONS

EPO Search Report, App. No. 00 124 844.2 - 2218, Feb. 17, 2005.*
EPO Search Report, App. No. 00 124 844.2 - 2218, Jun. 9, 2004.*
Takagi, T., et al., "Conceptual Matching and Its Applications to Selection of TV Programs and BGM", Systems, Man, and Cybernetics, 1999, IEEE SMC '99 Conference Proceedings, Tokyo, Japan Oct. 12-15, 1999, pp. 269-273.
Takagi, T. et al., "Realization of Sound-Scape Agent by Fusion of Conceptual Fuzzy Sets and Ontology", Fuzzy Systems Conference Proceedings, 1999 FUSS-IEEE '99, South Korea, Aug. 22, 1999, pp. 801-806.

* cited by examiner

APPARATUS PROVIDING INFORMATION WITH MUSIC SOUND EFFECT

BACKGROUND OF THE INVENTION

The present invention relates to apparatuses for creating and reproducing object information with performance information added thereto, for use in transmitting object information such as news or messages with background music through a network such as the Internet.

Conventionally, WWW (World Wide Web) servers have created and distributed news, weather forecasts and other kinds of information, while terminals have reproduced the information distributed thereto. Further, mail servers have distributed information such as messages created at and sent from message source terminals, and destination terminals have reproduced the information distributed thereto.

FIG. 11 is a schematic configuration diagram of an information distributing system for use in explaining conventional information creating apparatus and information reproducing apparatus.

In the drawing, reference numeral 201 denotes a personal computer terminal, 201*a* is a display unit, and 201*b* is a speaker. Reference numeral 202 denotes a public communication network, 203 is a server, 203*a* is a database, and 204 is a base station, 205 is a mobile terminal such as a potable telephone terminal, 205*a* is a display part, 205*b* is a receiver, and 205*c* is an interface connector. Further, reference numeral 206 is a personal computer terminal like the one indicated by the reference numeral 201, and 207 is a potable telephone terminal like the one indicated by the reference numeral 205.

Object information such as news or a message is stored in the database 203*a* of the server 203 in a format such as a text- information format, a static image information format, a dynamic image information format or the like. The personal computer terminal 201 establishes a dial-up connection to the server 203, for example, on the public communication network 202, reads object information from the database 203*a* in the form of the text information or the like, and displays the read information on its display part 201*a*.

Also stored in the database 203*a* is performance information written in a format such as an SMF (Standard Musical Instrument Digital Interface File) format or audio compressed data format. So, the personal computer terminal 201 may read the performance information together with the above-mentioned text information. Such an Internet service is known as the "MidRadio (Trademark)" or the "MIDPLUG for XG (Trademark)".

The text information used in the above-mentioned service, however, is merely provided for displaying a text indicative of the copyright or title of the music, which has not been accompanied with such background music as to fit the information contents of the news or message.

If performance information of background music that can suggest the contents of object information to be displayed were distributed together with the object information such as text information and image information, impact and impression of the object information such as news or a message could be increased, thereby adding value to the distributed object information.

Further, since the contents of the text or image information cannot be checked in a short time, a user may miss the information. In contrast, performance of background music that is in harmony with and therefore can suggest the contents of information allows the user to grasp the outline of the information in a short time, thereby enabling effective utilization of the information.

Suppose that a service provider changes background music according to the contents of information so as to suggest the contents of the information. Since music changes must be made manually, the production cost of news programs increases. There also arises another problem in music selection that varies depending on the personal skill or ability.

On the other hand, there is another type of service, called "Midmail (Trademark)", which provides the transmission of text messages accompanied with graphics and music from the personal computer terminal 201 to the personal computer terminal 206 through the server 203. In this service, a dial-up connection is established from the personal computer 201 to the server 203. Then, the user of the personal computer 201 individually selects items from a menu containing plural kinds of static image information and plural kinds of music information stored in the database 3*a*, and sends text messages together with partners' mail addresses at which the text messages are to be delivered. However, this service is provided in such a system as to allow the user on the message source side to manually select a music, not to realize automatic performance of BGM in matching to the contents of information.

SUMMARY OF THE INVENTION

The invention has been made to solve the above-mentioned problems, and it is an object thereof to provide an apparatus for creating object information with performance information added thereto, an apparatus for reproducing object information with performance information added thereto, an apparatus for creating object information with an expression element of characteristic information added thereto, and a recording medium with a program recorded thereon for realizing the above-mentioned functions. Such apparatuses allow the expressive effect on the object information to be enhanced, and hence allow the user to grasp the outline of the object information in a short time.

An inventive information producing apparatus is constructed for producing a combination of object information providing substantial contents and performance information providing a music piece in association with the substantial contents. The information producing apparatus comprises a source section that provides the object information having substantial contents, an extracting section that analyzes the provided object information to extract therefrom the characteristic information which is characteristic of the substantial contents of the provided object information, and an attaching section that operates based on the extracted characteristic information for attaching performance information to the provided object information such that the attached performance information can provide a performance of a music piece in association with the substantial contents.

Preferably, attaching section attaches the performance information containing music information which represents a music piece, and control information which controls the performance of the music piece represented by the music information.

Preferably, the information producing apparatus further comprises an output section that outputs the object information attached with the performance information.

Preferably, the information producing apparatus further comprises a storage section that stores a plurality of performance information corresponding to a plurality of music pieces, wherein the attaching section includes a searching section that searches the storage section to select therefrom a music piece according to the characteristic information.

Preferably, the extracting section analyzes the provided object information to extract therefrom the characteristic information in the form of a keyword which is contained in texts of the object information. Further, the extracting section extracts a keyword which indicates a mental impression derived from the substantial contents of the object information, and the attaching section attaches the performance information according to the keyword such that the music piece matches the mental impression indicated by the keyword.

Preferably, the extracting section analyzes the provided object information to extract therefrom the characteristic information in the form of a brightness of an image which is contained in the object information.

Preferably, the extracting section analyzes the provided object information to extract therefrom the characteristic information in the form of a color tone of an image which is contained in the object information.

Preferably, the source section provides the object information having substantial contents in the form of texts.

Preferably, the source section provides the object information having substantial contents in the form of graphics.

Preferably, the source section provides the object information having substantial contents in the form of videos.

An inventive information reproducing apparatus is constructed for reproducing performance information to provide a music piece in association with substantial contents of object information. The information reproducing apparatus comprises a receiving section that receives object information having substantial contents, an acquiring section that processes the received object information to acquire characteristic information which is characteristic of the substantial contents of the received object information, and a reproducing section that reproduces performance information according to the acquired characteristic information for providing a performance of a music piece in association with the substantial contents of the received object information.

Preferably, the reproducing section further reproduces the substantial contents of the received object information.

Preferably, the reproducing section reproduces the substantial contents of the received object information in synchronization to the performance of the music information, thereby imparting a music sound effect to the substantial contents.

Preferably, the information reproducing apparatus further comprises a storage section that stores a plurality of performance information corresponding to a plurality of music pieces, wherein the reproducing section includes a searching section that searches the storage section to select therefrom a music piece according to the acquired characteristic information.

Preferably, the reproducing section operates based on the performance information containing music information which represents the music piece, and control information which controls the performance of the music piece represented by the music information.

Preferably, the acquiring section processes the received object information to acquire therefrom the characteristic information in the form of a keyword which is contained in texts of the object information. Further, the acquiring section acquires the keyword which indicates a mental impression derived from the substantial contents of the object information.

Preferably, the acquiring section processes the received object information to acquire therefrom the characteristic information in the form of a brightness of an image which is contained in the object information.

Preferably, the acquiring section processes the received object information to acquire therefrom the characteristic information in the form of a color tone of an image which is contained in the object information.

An inventive information producing apparatus is constructed producing object information having substantial contents in combination with an identification code of the substantial contents. The information producing apparatus comprises a source section that provides the object information having substantial contents, an extracting section that analyzes the provided object information to extract therefrom characteristic information which is characteristic of the substantial contents of the provided object information, and an attaching section that attaches an identification code to the provided object information in correspondence to the extracted characteristic information such that the identification code indicates a characteristic of the substantial contents of the provided object information.

Preferably, the information producing apparatus further comprises an output section that outputs the provided object information together with the attached identification code.

Preferably, the attaching section further attaches music information representative of a music piece to the object information, the music piece being selected according to the identification code in association with the substantial contents of the provided object information.

Preferably, the information producing apparatus further comprises an output section that outputs the provided object information together with the music information.

Preferably, the attaching section includes an editing section operative based on the identification code for editing the music information to modify the music piece in association with the substantial contents of the object information.

Preferably, the editing section edits the music information to modify a sound equalizing of the music piece in association with the substantial contents of the object information.

Preferably, the editing section edits the music information to modify a performance style of the music piece in association with the substantial contents of the object information. For example, the editing section modifies the performance style of the music piece in terms of a music scale of the music piece. Otherwise, the editing section modifies the performance style of the music piece in terms of a rhythm or a tempo of the music piece.

Preferably, the attaching section further attaches control information to the object information for controlling a performance of the music piece. In such a case, the information producing apparatus further comprises an output section that outputs the provided object information together with the attached control information.

Preferably, the source section provides the object information having the substantial contents in the form of texts which is to be transmitted as a message by an email.

Preferably, the source section provides the object information having the substantial contents, which are distributed through Internet.

Preferably, the attaching section attaches the identification code in the form of a symbol code selected from a standard code set for information interchange in correspondence to the extracted characteristic information representative of a mental impression of the substantial contents.

Preferably, the attaching section attaches the identification code in the form of a symbol selected in correspondence to the extracted characteristic information to represent a mental impression of the substantial contents.

Preferably, the attaching section attaches the identification code in the form of a face mark selected in correspondence to the extracted characteristic information to represent a mental impression derived from the substantial contents.

Preferably, the extracting section analyzes the provided object information to extract therefrom the characteristic information in the form of a keyword which is contained in texts of the object information.

Preferably, the extracting section extracts the keyword which indicates a mental impression derived from the substantial contents of the object information.

Preferably, the extracting section analyzes the provided object information to extract therefrom the characteristic information in the form of a brightness of an image which is contained in the object information.

Preferably, the extracting section analyzes the provided object information to extract therefrom the characteristic information in the form of a color tone of an image which is contained in the object information.

An inventive information reproducing apparatus is constructed for reproducing performance information to provide a music piece in association with substantial contents of object information. The information reproducing apparatus comprises a receiving section that receives object information having substantial contents together with an identification code which indicates a characteristic of the substantial contents of the object information, and a reproducing section that operates based on the identification code so as to reproduce performance information for providing a performance of a music piece in association with the substantial contents of the received object information, the music piece being selected according to the identification code.

Preferably, the reproducing section further reproduces the substantial contents of the received object information.

Preferably, the reproducing section includes an editing section operative based on the identification code for editing music information which is contained in the performance information and which is representative of the music piece such that the music piece is modified in association with the substantial contents of the object information.

An inventive information reproducing apparatus is constructed for reproducing music information to provide a performance of a music piece in association with substantial contents of object information. The information reproducing apparatus comprises a receiving section that receives object information having substantial contents together with an identification code which indicates a characteristic of the substantial contents of the object information, a searching section that operates according to the identification code for searching control information effective to control the performance of the music piece, and a reproducing section that reproduces the music information for providing the performance of the music piece while controlling the performance of the music piece according to the searched control information in association with the substantial contents of the received object information.

An inventive information producing apparatus is constructed for producing object information containing substantial contents in combination with an identification code of the substantial contents. The information producing apparatus comprises a source section that provides object information having substantial contents, an acquiring section that acquires an identification code indicative of a characteristic of the substantial contents of the provided object information, a generating section that operates based on the acquired identification code for generating a music piece in association with the substantial contents of the provided object information, thereby evaluating whether the music piece is fit for the object information, and an output section that outputs the object information together with the identification code after the evaluating.

Preferably, the information producing apparatus further comprises a monitoring section that monitors the substantial contents of the object information in synchronization to the generating of the music piece.

An inventive data structure is designed for use in transfer of information. The data structure comprises first data representing object information containing substantial contents to be transferred, and second data representing identification information indicating a characteristic of the substantial contents of the object information, wherein the identification information is allotted to the object information by searching a keyword which is involved in the substantial contents of the object information and which is characteristic of the substantial contents of the object information.

Preferably, the identification information comprises a symbol code selected from a standard code set for information interchange in correspondence to the searched keyword, the symbol code being associative of a mental impression derived from the characteristic of the substantial contents of the object information.

Preferably, the identification information comprises a symbol selected in correspondence to the searched keyword, the symbol being associative of a mental impression derived from the characteristic of the substantial contents of the object information.

Preferably, the identification information comprises a face mark being composed of a combination of symbols and characters and being selected in correspondence to the searched keyword, the face mark being associative of a mental impression derived from the characteristic of the substantial contents of the object information.

Preferably, the identification information is allotted to the object information by searching a keyword which is characteristic of the substantial contents of the object information in terms of a mental impression derived from the substantial contents of the object information.

An inventive data structure is designed for use in transfer of information. The data structure comprises first data representing object information containing substantial contents to be transferred, and second data representing music information representing a music piece being associative of a characteristic of the substantial contents of the object information, wherein the music piece is allotted to the object information by searching a word which is involved in the substantial contents of the object information and which directly or indirectly indicates a mental impression derived from the characteristic of the substantial contents of the object information.

An inventive data structure is designed for use in transfer of information. The data structure comprises first data representing object information containing substantial contents to be transferred to a destination, such that the substantial contents can be presented along with a performance of a background music in the destination, and second data representing control information effective to control the performance of the background music in association with a characteristic of the substantial contents of the object information, wherein the control information is allotted to the object information by searching a word which is involved in the substantial contents of the object information and which directly or indirectly indicates a mental impression derived from the characteristic of the substantial contents of the object information.

An inventive data structure is designed for use in transfer of information. The data structure comprises first data representing object information containing substantial contents to be transferred in the form of texts, and second data representing identification information indicating a characteristic of the substantial contents of the object information, wherein the identification information is allotted to the object information by detecting a characteristic of the substantial contents form the texts.

An inventive data structure is designed for use in transfer of information. The data structure comprises first data representing object information containing substantial contents to be transferred in the form of graphics, and second data representing identification information indicating a characteristic of the substantial contents of the object information, wherein the identification information is allotted to the object information by detecting a characteristic of the substantial contents form the graphics.

An inventive data structure is designed for use in transfer of information. The data structure comprises first data representing object information containing substantial contents to be transferred in the form of videos, and second data representing identification information indicating a characteristic of the substantial contents of the object information, wherein the identification information is allotted to the object information by detecting a characteristic of the substantial contents form the videos.

DETAILED DESCRIPTION OF THE INVENTION

Figure 1:
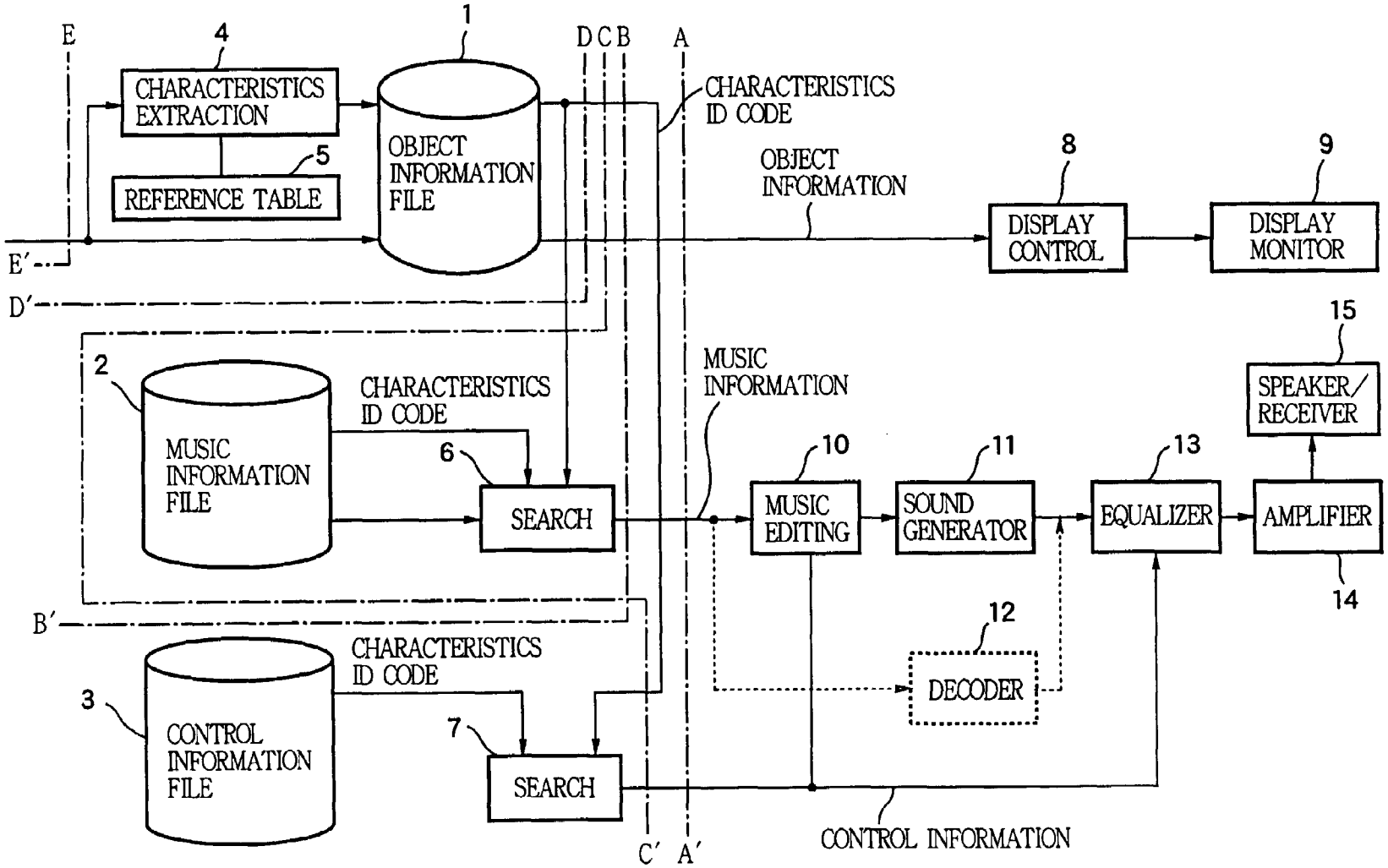
FIG. 1 is a system configuration diagram for explaining apparatuses for creating and reproducing object information with performance information added thereto according to first to fifth embodiments of the invention.

FIG. 1 is a system configuration diagram for use in explaining apparatuses for creating and reproducing object information with performance information added thereto according to first to fifth embodiments of the invention.

In the drawing, reference numeral 1 denotes an object information file section, 2 is a music information file section, 3 is a control information file section, 4 is a characteristic extracting section and 5 is a reference table. Reference numerals 6 and 7 denote search sections, 8 is a display control section, 9 is a display monitor, 10 is a music editing section, 11 is a sound generator, 12 is a decoder, 13 is an equalizer, 14 is an amplifier, and 15 is a speaker/receiver.

This system displays object information on the display monitor 9, while it creates such performance information as to fit the object information and outputs the same from the speaker/receiver 15.

The performance information may include music information and control information that is to control the music information. According to the invention, at least either the music information or the control information is made to fit the contents of the object information.

To fit the performance information to the contents of the object information, a characteristic of the contents of the object information is extracted in the characteristic extracting section 4.

In the system configuration shown in FIG. 1, the apparatus for creating or producing object information with performance information added thereto and the apparatus for reproducing the object information can be practiced in plural embodiments depending on how to share the functions therebetween. As shown, dot-dash lines as indicated by A-A' through E-E' indicate function sharing boundaries through which information is exchanged between both sides.

Figure 11:
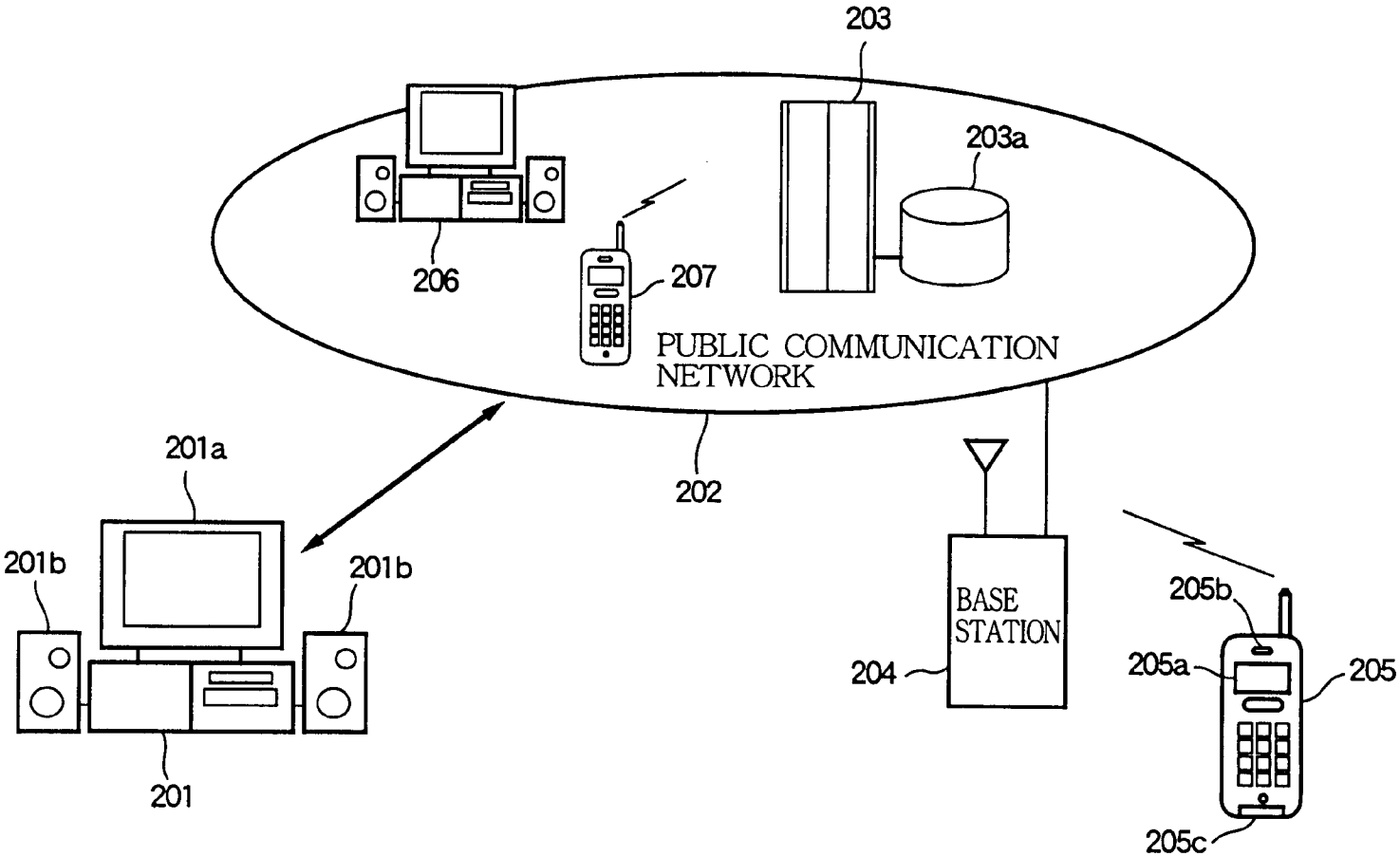
FIG. 11 is a schematic configuration diagram of an information distributing system for use in explaining conventional information creating apparatus and information reproducing apparatus.

Referring also to the prior-art distribution system of FIG. 11, the system configuration shown in FIG. 1 allows news or mail distribution between the server 203 and the personal computer terminals 201, 206, and the mobile terminal 205, 207 (hereinbelow, generically called the terminals unless particularly mentioned). In the news distribution, the server 203 is the information creating apparatus to distribute created information to the terminals, while the terminals are the information reproducing apparatuses.

In the mail distribution, message source terminals are the information creating apparatuses, the server 203 is the information creating apparatus as a relay station to transfer the mails, and destination terminals are the information reproducing apparatuses. This system can be practiced in plural embodiments depending on how to share the functions between the information creating apparatus and the information reproducing apparatus. As shown, the dot-dash lines as indicated by A-A' through E-E' indicate function sharing boundaries through which information is exchanged between both sides.

First of all, respective blocks in the system are illustrated, and then-operations of the first through fifth embodiments different in function sharing are described.

The object information file section 1 inputs object information to be displayed on the display monitor 9, and stores the object information together with characteristic ID (identification) code to be described later. The object information is a kind of visibly displayable information such as text information, static image information and dynamic image information, or a combination of these kinds of information. The object information is input on a keyboard or through a pointing device. Further, the object information may be input in such a voice recognition system as to input voiced news, readings, conversations, instructions and so on. Alternatively, object information prerecorded on a recording medium may be read out, or input through a network.

The characteristic extracting section 4 analyzes a characteristic of the contents of the object information. Since a correspondence table of characteristic information to characteristics ID code is prestored in the reference table 5, the characteristic extracting section 4 checks the analyzed characteristic with the characteristic information stored in the reference table 4*a*. Then, the extracting section 4 outputs a characteristics ID code corresponding to the characteristic information with the highest degree of correlation, and stores the same into the object information file section 1.

The characteristic may be analyzed in terms of human sensibilities. To be more specific, the characteristic is analyzed in terms of human sensibilities (feelings of gladness, anger, sadness and pleasure) to the contents of news or message such as, atmospheres or moods that suggest the sensibilities (e.g., nice, high-spirited, dignified, light and romantic), living scenes that suggest the sensibilities (e.g., scenery, seasons and yearly events), and the like. An individual characteristics ID code is assigned to each type of characteristics.

For example, characteristics ID code "000" indicates "glad", "001" is "angry", "002" is "sad", "003" is "pleasant" and so on. Characteristics ID code "100" indicates a "good atmosphere", "101" is a "high-spirited atmosphere, "102" is an "atmosphere of dignity", "103" is an "atmosphere of lightness", "104" is a "romantic mood", and so on. Characteristics ID code "200" indicates a "mountain", "201" is a "sea", and so on.

If the text of the object information says, "I had a good time today," "good" is extracted and the characteristics ID code "100" is given. Then, a music title suitable for the word "good" is selected and the selected music is played after control or tuning of the music to be fitted to the word "good" such as music editing (arrangement) or equalizer adjustment (adjustment of frequency characteristics). If it says, "I felt sad today," "sad" is extracted and the characteristics ID code "002" is given. Then, musical arrangement or equalizer adjustment is so made that the music will fit the word "sad". If it says, "A live broadcast from a sea-house on a beach today," the word "sea" is extracted and the characteristics ID code "201" is given. Then, a music tone of waves is sounded.

In addition, if a country name is extracted, a piece of music with a musical scale or rhythm peculiar to the country is selected, or a national anthem corresponding to the country is selected, or a musical arrangement is so made by editing a scale and rhythm that the music will be played in such a style as to fit the image of the country. Further, the object information may contain weather forecast. When the information associated to the weather forecast is extracted from the object information, a music piece associated to the weather forecast may be selected. For example, if the weather forecast contains the message "it is rain tomorrow", a music piece associative of rain fall may be selected.

Namely, in the inventive information reproducing apparatus, the reproducing section includes an editing section operative based on the identification code for editing music information which is contained in the performance information and which is representative of the music piece such that the music piece is modified in association with the substantial contents of the object information. For example, the editing section edits the music information to modify a sound equalizing of the music piece in association with the substantial contents of the object information. Otherwise, the editing section edits the music information to modify a style of the performance of the music piece in association with the substantial contents of the object information. In detail, the editing section modifies the style of the performance of the music piece in terms of a music scale of the music piece. Otherwise, the editing section modifies the style of the performance of the music piece in terms of a rhythm or a tempo of the music piece.

The process of extracting a characteristic varies according to the type of medium by which the object information is made up. For example, if the object information is a text, the text is searched and an extracted keyword is looked up in a sensuous word dictionary stored in the reference table 5. Then, a characteristics ID code assigned to a keyword identical or similar to the extracted word is output.

The following briefly describes how to extract a characteristic of an image such as a graphic image or photo. One approach is to automatically detect the brightness (Y value) or color (RGB values) of the image, calculate the average value of the detected values and output such a characteristics ID code as to correspond to the average value of the brightness or each color.

For example, if the image tone is bright, the characteristics ID code "100" corresponding to the word "good" is given, and the image is processed in the same manner. If the image tone is dark, the characteristics ID code "002" corresponding to the word "sad" is given and processed in the same manner. Further, text information can also be handled as special image information and its characteristic may be determined on the basis of the RGB values of the color of the characters or the background color, or its brightness. If the image is a dynamic or time-varying image, the rate of change in movement of a subject may be given a correspondence with a feeling.

Namely, in the information producing apparatus, the extracting section analyzes the provided object information to extract therefrom the characteristic information in the form of a brightness of an image which is contained in the object information. Otherwise, the extracting section analyzes the provided object information to extract therefrom the characteristic information in the form of a color tone of an image which is contained in the object information.

Such characteristics, namely colors, phrases in a text, words, kanji or Chinese characters, and so on are given correspondences with plural kinds of human sensibilities, and stored in the reference table 5 as data written in a dictionary format. The dictionary may be so customized that each user is free to register any characteristic in the dictionary. Alternatively, such a dictionary may be downloaded through a network.

By the way, the information producing apparatus treats the object information having the substantial contents in the form of texts. Further, the information producing apparatus treats the object information having the substantial contents in the form of graphics. Moreover, the information producing apparatus treats the object information having the substantial contents in the form of videos.

The music information file section 2 can store many pieces of music as music information. The music information is stored in a MIDI file such as an SMF, with respective characteristics ID code assigned thereto. In general, one characteristics ID code is assigned to one piece of music. However, plural kinds of characteristics ID codes may be assigned to one piece of music. For example, a piece of music may be given a correspondence with characteristics ID codes corresponding to "bright" and "pleasant". Further, the MIDI file may contain lyric information as a "meta event", and the music information may be compressed in musical waveform data.

Prescribed in a setup measure (bar) part of a MIDI file are, for example, control information, such as time, tempo, bank selection, program change (timbre), volume, expression (sound volume), reverb, chorus, scale, key (tune), frequency characteristics and so on, and other information such as copyright information including the composer's name and lyricist's name. The song body part after the setup measure part also contains the control information as well as note data.

The characteristic the music information is analyzed each time the music information is stored. After that, the information is stored in the music information file section 2 together with a characteristics ID code determined on the basis of various parameters contained in the above-mentioned control information of the music information.

To be more specific, the characteristic is analyzed, for example, in terms of human sensibilities on the basis of set values of timbre, tempo, sound volume, tune and the like written in the setup measure part. If the title of the song or lyrics is contained, the characteristic can be extracted in the same manner as that of the text information. Alternatively, the characteristic of the contents of the music information may be analyzed in the process of search when plural kinds of music information are read out one by one.

The control information file section 3 is provided for use in storing such control information as to control the style of reproducing music information. One specific example is a template modified from the above-mentioned setup measure part on the basis of the characteristic determined in terms of human sensibilities. The control information file section 3 attaches a characteristics ID code to the template and stores a great number of templates. In general, a characteristics ID code is assigned to a template. However, as mentioned above in the case of the music information file section 2, plural kinds of characteristics ID codes may be assigned to one template and stored in the control information file section 3.

The characteristic of the control information is analyzed when the control information is stored in the control information file section 3. After that, the control information is given a correspondence with a characteristics ID code on the basis of parameters contained in the control information, and stored together with the characteristics ID code. Alternatively, the characteristic may be analyzed while reading the templates from the control information file section 3 so that a template having a specified characteristic can be retrieved.

The above-mentioned template can change the reproduction style of a music piece by controlling at least one of set values of timbre, tempo, sound volume and tune. For example, the template may change the timbre of a piano to that of a bright piano, or to that of a mellow piano. It may also change the tempo or sound volume by specifying a certain value or a certain rate (relative value) determined from a reference value predetermined in the music information.

In this case, if the control information is set by a numerical value, it is desirable to specify a value in consideration of the tempo or tune predetermined in the music data, not to set a certain rate uniformly. For example, in the case where the tempo is to be speeded up, if the music has originally a high tempo, the rate of change should be reduced. Alternatively, the template of the control information may have both ideal and relative values for the tempo or sound volume. In this case, the template does not change the tempo or sound volume when the value originally set in the music information is within the range of specified values, and the template changes the rate according to the relative value when the original value is out of the range. In addition, the key or tune of a scale can be changed from major to minor, or from minor to major, or the key may be shifted.

Parameters other than the above-mentioned ones can also be controlled for use in controlling the reproduction style of music. For example, setting of the number of channels capable of sounding at the same time can be changed to control the presence or absence of chord performance, the number of performance parts, and the presence or absence of added automatic performance.

The search section 6 for the music information outputs characteristics ID codes and their associated music information one by one. Then, the respective outputs of the characteristics ID codes are checked with the characteristics ID code of the object information to output music information with its characteristics ID code corresponding to that of the object information.

On the other hand, the search section 7 for the control information outputs characteristics ID codes and their associated templates of control information one by one. Then, the respective outputs of the characteristics ID codes are checked with the characteristics ID code of the object information to output a template with its characteristics ID code corresponding to that of the object information.

If the object information has two or more characteristics ID codes, or if plural kinds of music information share a characteristics ID code, certain criteria are used to output optimum music information. The process of searching and retrieving the control information is similar to that of the music information.

The display control section 8 controls the display monitor 9 to display the object information when control means, not shown, outputs desired object information and its characteristics ID code from the object information file section 1. On the other hand, the characteristics ID code is supplied to the search sections 6 and 7 so as to output music information and control information, both of which are given the corresponding characteristics ID code.

The music editing section 10 receives the music information from the search section 6 and edits the music piece. For example, the setup measure part of the music information is replaced by the template of the control information output from the search section 7.

Alternatively, as mentioned above, a relative value specified in the template of the control information may be multiplied to change the value, and may be output to the sound generator 11. Further, if a change of key is instructed, the music is edited according to the instruction.

The sound generator 11 receives the edited music information, generates a tone signal and outputs the same to the equalizer 13. The equalizer 13 changes frequency characteristics of a filter on the basis of the equalizer characteristic specifying information contained in the template of the control information to output the tone signal from the speaker/receiver 15 through the amplifier 14.

Display of the object information and play of the music performance can be started automatically, or in synchronism with a user's start operation. Namely, the information reproducing apparatus reproduces the substantial contents of the received object information in synchronization to the performance of the music information, thereby imparting a music sound effect to the substantial contents. Alternatively, the user may instruct the start of the music performance after the start of the information display. If the performance is started prior to the start of display, the user may be informed of the contents of the display beforehand to decide whether the object information is to be displayed or not.

Thus, the display of the object information and play of the music are started in several different modes. For this, display mode specifying information is output from the information creation side so that the information reproduction side can switch the modes on the basis of the display mode specifying information. That is, the user on the side of the information reproducing apparatus can select any mode.

The music to be played is background music over the display of the object information. If a SMF is used, a melody of the music is played.

Further, if the sound generator 11 is an independent sound generator such as a sampler, waveform data with an extension "wav" can be used as music information as it is. An audio-compressed digital waveform can also be used as music information. In this case, vocal performance is made possible. For audio compression, various techniques such as "sound VQ (Trademark)" and "MP3 (MPEG1 Audio Layer 3)" are adopted. In this case, as shown by the broken line in FIG. 1, the music information is output from the search section 6 to the decoder 12 where the music information is unpacked. The unpacked or decompressed music information is then output to the equalizer 13. The equalizer 13 regulates the audio waveform on the basis of the equalizer characteristic specifying information contained in the control information to impart a frequency characteristic corresponding to the characteristic of the contents of the object information. After that, the regulated audio waveform is output to the speaker/receiver 13 through the amplifier 14.

In the above description, both the music information and the control information are selected according to the characteristic of the contents of the object information. However, the music information may be a prescribed pattern or a piece of music, may be selected at user's discretion, with editing only the reproduction style in such a manner as to fit the music performance to the characteristic of the contents of the object information.

In reverse, the music may be selected according to the characteristic of the contents of the object information. In this case, the reproduction style may be either originally specified for the music information or selected at user's discretion.

Referring next to the system configuration diagram of FIG. 1, the following illustrates the first through fifth embodiments of the apparatuses for creating and reproducing object information with performance information added thereto. Different points among the first through fifth embodiments are that burden sharing varies between the information creating process executed on the side of the server 203 shown in FIG. 11 and the information reproducing process executed on the side of the terminals.

The first embodiment is characterized by dot-dash line A-A' on the boundary between the apparatuses for creating and reproducing object information with performance information added thereto. In this embodiment, all the operations executed by the display control section 8, the music editing section 10 and the subsequent parts are carried out on the terminal side of the information reproducing apparatus.

In operation, the information creating apparatus on the server side sends object information, music information, and control information. Upon receipt of all the information, the information reproducing apparatus on the terminal side displays the object information on the display monitor 9, while the reproducing apparatus controls, on the basis of the control information, the music editing section 10 and the equalizer 13 to play music. If the object information is to be varied, for example, by line scrolling, the display of the object information is synchronized with the start of music performance on a frame to a frame basis.

In the embodiment, the person in charge of the side of the information creating apparatus specifies the control information. Alternately, the user on the side of the information reproducing apparatus receives the specified control information as suggested information, and the control information can be adjusted or modified according to user preferences, which makes possible music editing and equalizer control on the side of the information reproducing apparatus.

The above-mentioned first embodiment can be modified as follows. First of all, the information creating apparatus on the server side may carry out the function of the music editing section 10. That is, the information reproducing apparatus on the terminal side carries out the operations executed by the sound generator 11, the decoder 12 and the subsequent parts. In this case, the information creating apparatus sends object information, music information musically edited, and control information for use in controlling the equalizer. Upon receipt of all the information, the information reproducing apparatus recognizes the control information to play music while controlling the equalizer 13.

Second, the information reproducing apparatus on the terminal side may carry out only the operations executed by the display control section 8, the amplifier 14, and speaker/receiver 15. That is, the remaining parts on the left side are carried out by the information creating apparatus on the server side. In this case, the information reproducing apparatus on the terminal side is in no need of a special configuration. Such an arrangement is suitable for use with any conventional potable telephone terminal.

The second embodiment is characterized by dot-dash line B-B' on the boundary between the apparatuses for producing and reproducing object information with performance information added thereto. Unlike the first embodiment, this embodiment is designed to have the information reproducing apparatus on the terminal side carry out the functions of the control information file section 3 and the search section 7.

In operation, the information producing apparatus on the server side sends a characteristics ID code, object information and music information. Upon receipt of the information, the information reproducing apparatus on the terminal side uses the characteristics ID code to retrieve, from the control information file section 3, control information to which the characteristics ID code is assigned. Then, the reproducing apparatus controls, on the basis of the control information, the music editing section 10 and the equalizer 13 to play music.

Namely, in the information producing apparatus, the attaching section attaches music information representative of a music piece to the object information, the music piece being selected according to the identification code in association with the substantial contents of the provided object information. On the other hand, the information reproducing apparatus is constructed for reproducing music information to provide a performance of a music piece in association with substantial contents of object information. In the information reproducing, a receiving section receives object information having substantial contents together with an identification code which indicates a characteristic of the substantial contents of the object information. A searching section operates according to the identification code for searching control information effective to control the performance of the music piece. A reproducing section reproduces the music information for providing the performance of the music piece while controlling the performance of the music piece according to the searched control information in association with the substantial contents of the received object information.

According to the second embodiment, the user on the side of the information reproducing apparatus is free to change the correspondence between the characteristic information and the reproduction style of the music. The templates of plural kinds of control information stored in the control information file section 3, together with a program implementing the functions of the information reproducing apparatus, can be installed and initially set up through a recording medium or network. Even after initially set up, the programs and data can be additionally downloaded from the recording medium or through the network at any time. Further, the user can create his or her own templates.

The third embodiment is characterized by dot-dash line C-C' on the boundary between the apparatuses for producing and reproducing object information with performance information added thereto. Unlike the second embodiment, this embodiment is designed to have the information reproducing apparatus on the terminal side carry out the functions of the music information file section 2 and the search section 6. On the other hand, the information producing apparatus attaches control information to the object information for controlling a performance of the music piece.

According to the third embodiment, the user on the side of the information reproducing apparatus is free to change the correspondence between the characteristic information and the music information. The music information file section 2, together with a program implementing the functions of the information reproducing apparatus, can be installed and initially set up through a recording medium or network. Further, the user can compose any music, or download any music through the network.

The fourth embodiment is characterized by dot-dash line D-D' on the boundary between the apparatuses for producing and reproducing object information with performance information added thereto. In this embodiment, the information reproducing apparatus carries out the functions of the music information file section 2, the search section 6, the control information file section 3 and the search section 7. On the other hand, 25. the information producing apparatus includes an output section that outputs the object information together with the identification code.

In operation, the information producing apparatus sends a characteristics ID code and object information. Upon receipt of these information, the information reproducing apparatus uses the characteristics ID code to retrieve, from the music information file section 2, music information to which the characteristics ID code is assigned. The reproducing apparatus also retrieves, from the control information file section 3, control information to which the characteristics ID code is assigned. Then, the information reproducing apparatus controls, on the basis of the control information, the music editing section 10 and the equalizer 13 to play music.

The fifth embodiment is characterized by dot-dash line E-E' on the boundary between the apparatuses for producing and reproducing object information with performance information added thereto. This embodiment is designed to have the information reproducing apparatus on the terminal side carry out, in addition to those in the fourth embodiment, the functions of the object information characteristic extracting section 4 and the reference table 5. That is, the side of the object information producing or creating apparatus sends only the object information, while the side of the object information reproducing apparatus selects music information according to the characteristic of the contents of the object information, and changes the reproduction style such as musical tune and tone timbre.

In operation, the information reproducing apparatus side extracts characteristic information from the object information to output a characteristics ID code. Then, the reproducing apparatus retrieves, from the music information file section 2, music information to which the characteristics ID code is assigned, and outputs the music information. The reproducing apparatus also retrieves, from the control information file section 3, a template of the control information to which the characteristics ID code is assigned. Finally, The reproducing apparatus controls, on the basis of the control information, the music editing section 10 and/or the equalizer 13 to play music.

Namely, the information reproducing apparatus is constructed for reproducing performance information to provide a music piece in association with substantial contents of object information. In the information reproducing apparatus, a receiving section receives object information having substantial contents. An acquiring section processes the received object information to acquire characteristic information which is characteristic of the substantial contents of the received object information. A reproducing section reproduces performance information according to the acquired characteristic information for providing a performance of a music piece in association with the substantial contents of the received object information.

According to the fifth embodiment, the apparatus for reproducing object information with performance information added thereto allows the user to set how to extract a characteristic of the object information. Further, the information creating apparatus merely sends object information, and so any conventional WWW server is usable without any change.

The reference table 5 is initially installed from a recording medium or network, and can be additionally installed at the time of revision. Even when the music information file section 2 and the control information file section 3 are placed on the server side, these files may be reserved on a server different from the server on which the object information file section 1 is placed. This makes it possible to decentralize database operation.

In the above-mentioned first through fifth embodiments, the information creating apparatus and the information reproducing apparatus are adaptable to both or either of music information written in the MIDI file format and music information written in the waveform data format.

Further, the information creating apparatus and the information reproducing apparatus may have two or more operation modes. In this case, the user can select a desired mode, and hence can select any one of the above-mentioned embodiments.

In the above-mentioned second through fifth embodiments, the information reproducing apparatus uses a characteristics ID code sent from the information creating apparatus to search and select music information or control information. However, the information reproducing apparatus may not store in its files music information and/or control information that are given a correspondence with the characteristics ID code received. In such a case, the information reproducing apparatus requests the absent music information or control information from the information creating apparatus.

Figure 2:
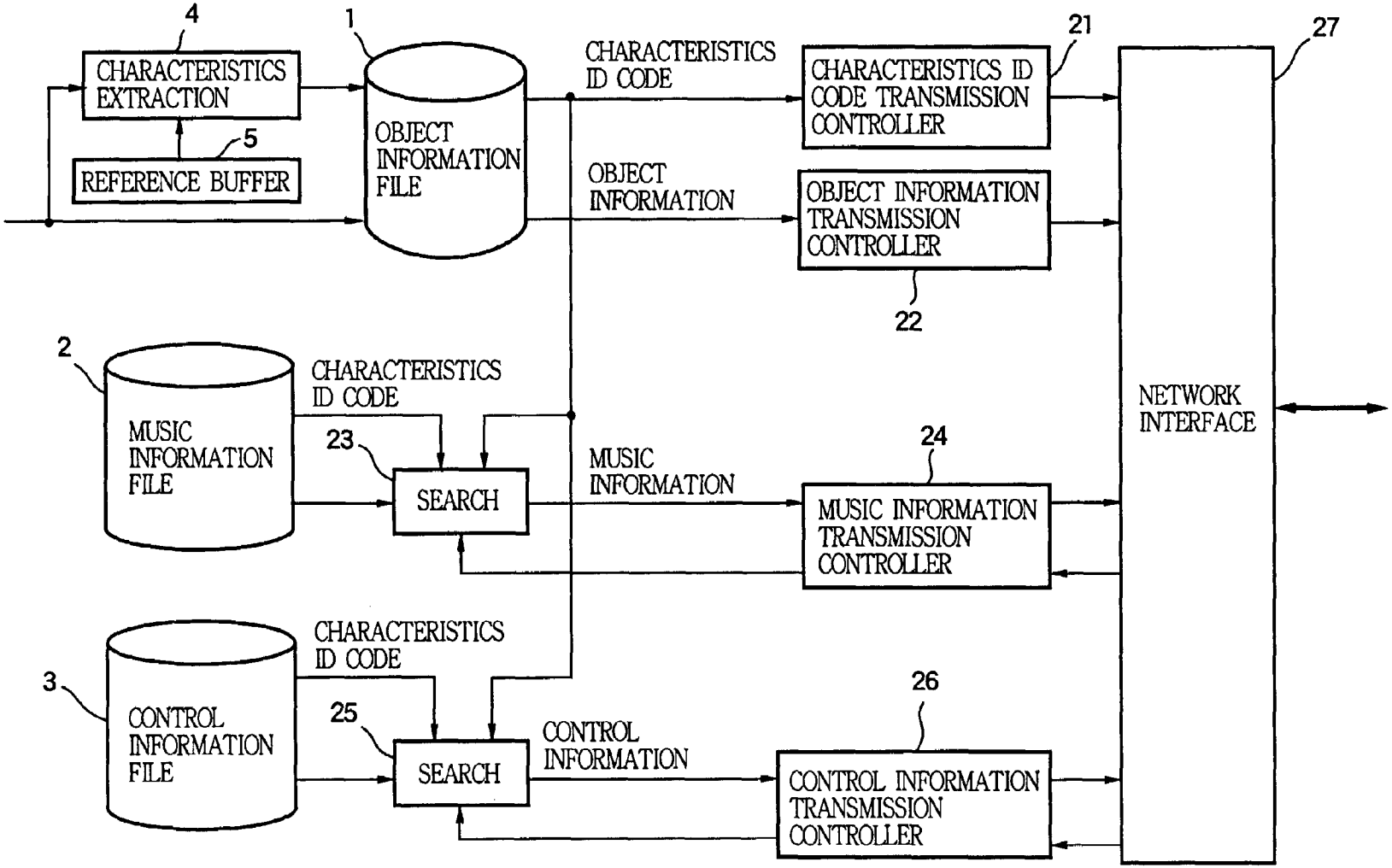
FIG. 2 is a block diagram for explaining an apparatus for creating object information with performance information added thereto according to a sixth embodiment of the invention.

The following illustrates a specific example in which the configuration mentioned just above is embodied in the fourth embodiment. FIG. 2 is a block diagram for explaining a sixth embodiment of the apparatus for creating object information with performance information added thereto. In the drawing, portions like those in FIG. 1 are given the same reference numerals and the description thereof is omitted. In the drawing, reference numeral 21 denotes a characteristics ID code transmission controller section, 22 is an object information transmission controller section, 23 is a search section, 24 is a music information transmission controller section, 25 is a search section, 26 is a control information transmission controller section, and 27 is a network interface.

Figure 3:
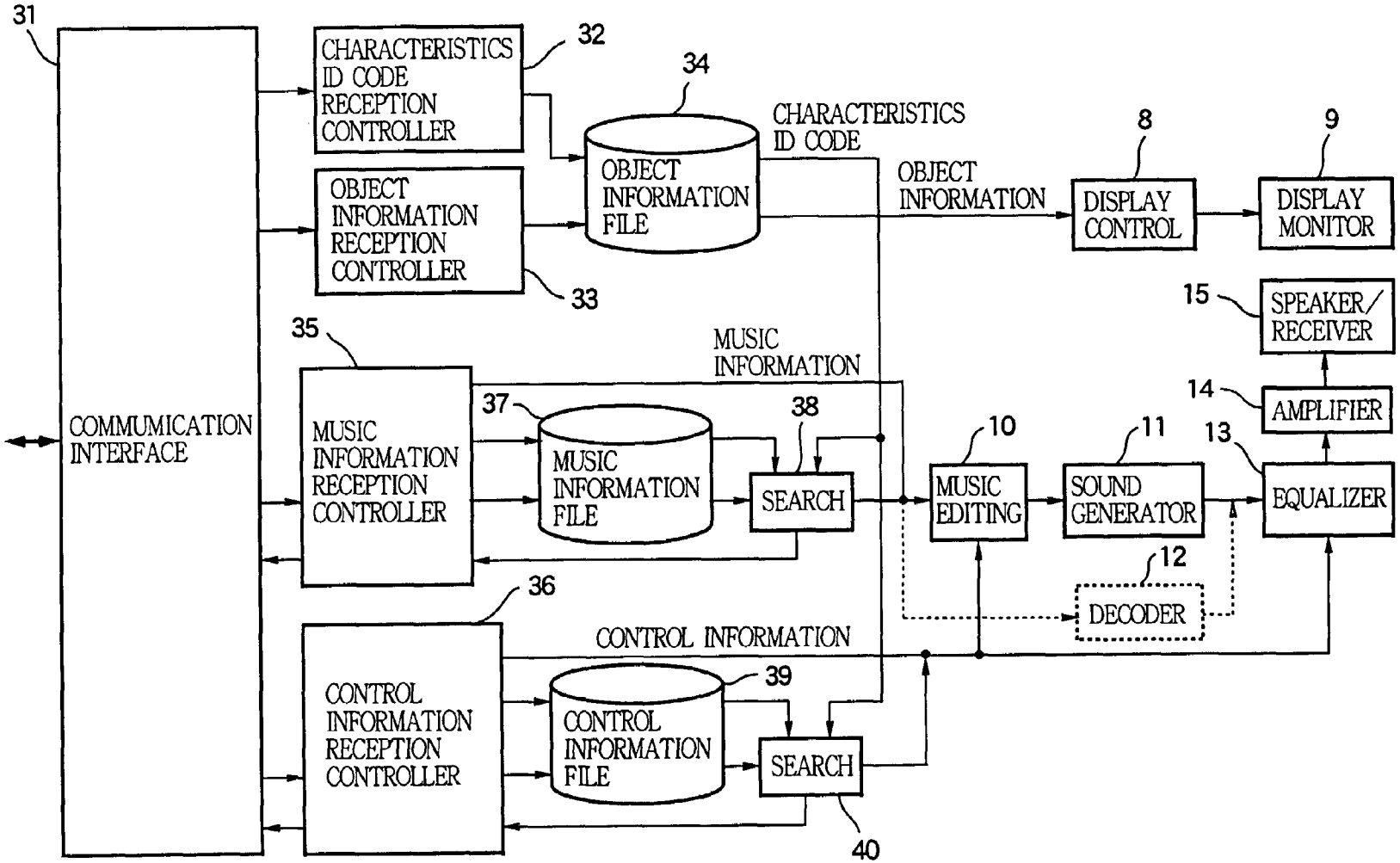
FIG. 3 is a block diagram for explaining an apparatus for reproducing object information with performance information added thereto according to the sixth embodiment of the invention.

FIG. 3 is a block diagram for explaining the sixth embodiment of the apparatus for reproducing object information with performance information added thereto. In the drawing, portions like those in FIG. 1 are given the same reference numerals and the description thereof is omitted. In the drawing, reference numeral 31 is a network interface, 32 is a characteristics ID code reception controller section, 33 is an object information reception controller section, 34 is an object information file section, 35 is a music information reception controller section, 36 is a control information reception controller section, 37 is a music information file section, 38 is a search section, 39 is a control information file section, and 40 is a search section.

In FIG. 2, the characteristics ID code transmission controller section 21 and the object information transmission controller section 22 output a characteristics ID code from the object information file section 1 and object information from the object information file section 1, respectively, through the network interface 26 to the terminal side as shown in FIG. 3.

In FIG. 3, the object information reception controller section 33 receives the object information through the network interface 31, and stores the same into the object information file section 34. The characteristics ID code reception controller section 32 receives the characteristics ID code and stores the same into the object information file section 34 together with the object information.

The object information file section 34 outputs the object information to the display control section 8, while the same section 34 outputs the characteristics ID code to the search sections 38 and 40. The search section 38 retrieves, from the music information file section 37 locally provided on the terminal side, music information to which the received characteristics ID code is assigned. Then, the same section 38 outputs the music information to the music editing section 10.

The search section 40 retrieves, from the control information file section 39 locally provided on the terminal side, control information to which the received characteristics ID code is assigned. Then, the same section 40 outputs the control information to the music editing section 10 and the equalizer 13.

Here, if there is no music information having the characteristics ID code received, the search section 38 actuates the music information reception controller section 35 to request the transmission of the required music information from the server side. Upon receipt of the request, the music information transmission controller section 24 on the server side shown in FIG. 2 actuates the search section 23 to retrieve and send to the terminal side the music information having the characteristics ID code. Then, the music information reception controller section 35 stores the received music information into the music information file section 36 together with the characteristics ID code, while the same section 35 outputs the music information to the music editing section 10 and the decoder 12. Thus, the music information once received is stored in the music information file section 35 on the terminal side.

Similarly, if there is no control information having the input characteristics ID code, the search section 40 actuates the control information reception controller section 36 to request the control information from the server side.

Upon receipt of the request, the control information controller section 26 on the server side shown in FIG. 2 actuates the search section 25 to retrieve and send to the terminal side the control information having the characteristics ID code. Then, the control information reception controller section 36 stores the received control information into the control information file section 39 together with the characteristics ID code, while the same section 36 outputs the control information to the music editing section 10 and the equalizer 13.

In the above description, a request is made when there is no music information or control information on the side of the information reproducing apparatus. However, such information may be downloaded from another server on the network.

Suppose that music information or control information, to which no characteristics ID code is assigned, is downloaded. In this case, the information reproducing apparatus may extract a characteristic automatically, or at user's discretion, assign a characteristics ID code, and store the music information or control information into the music information file section 37 or control information file section 39 together with the characteristics ID code.

The following describes hardware configurations of the server and the terminal. The server side is designed such that a database server is connected to an application server, the application server is connected to a web server, and the web-server is connected to the Internet through an access controller. These servers and the access controller carry out the functions on the server side shown in FIG. 1 or 2.

On the other hand, the terminal side is configured by a personal computer terminal having a music reproducing function that carries out the functions on the terminal side shown in FIG. 1 or 3.

Figure 4:
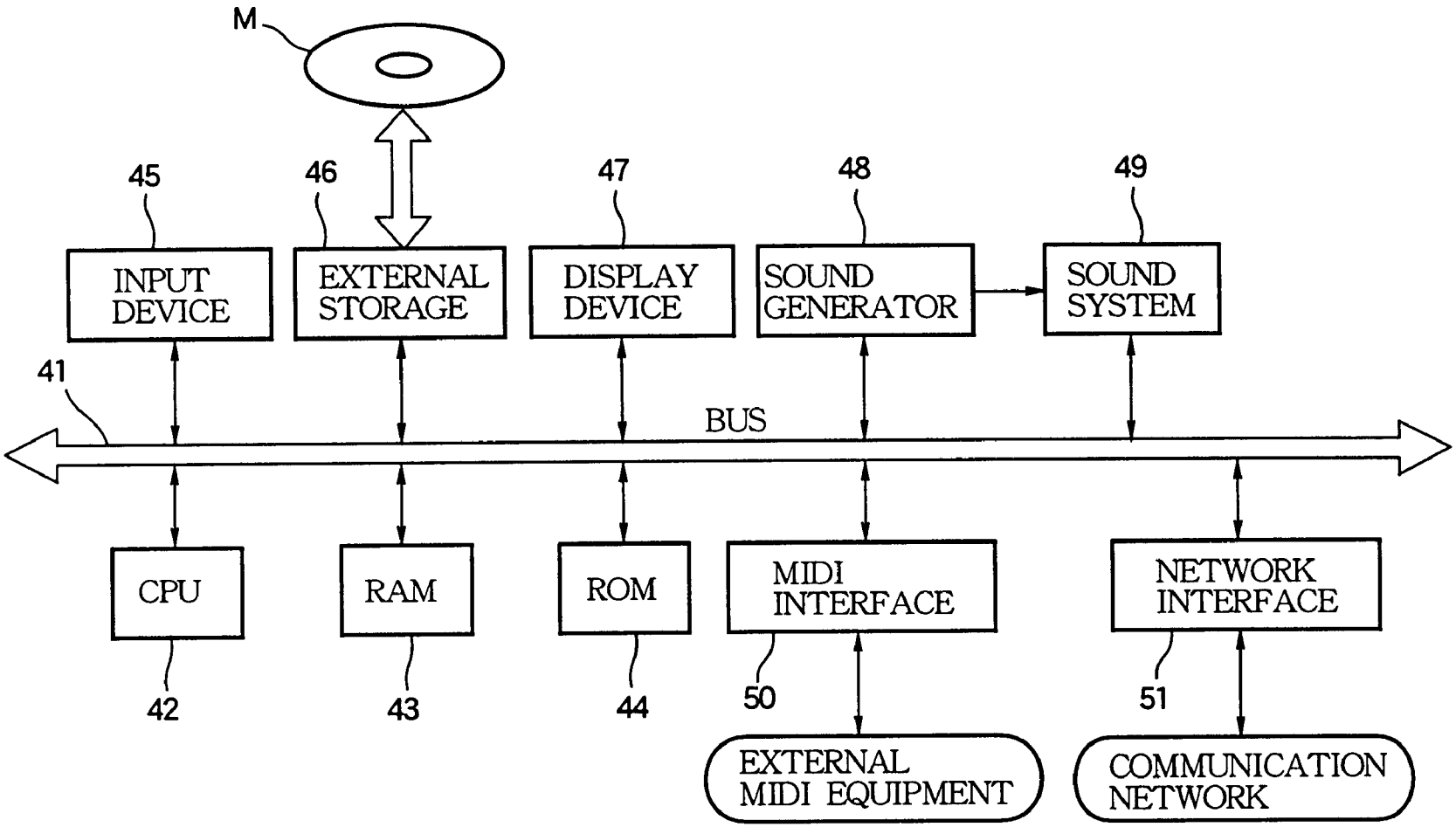
FIG. 4 is a block diagram for explaining a hardware configuration of a terminal that embodies the apparatus for reproducing object information with performance information added thereto according to the invention.

FIG. 4 is a block diagram for explaining the hardware configuration of the terminal side for implementing the apparatus for reproducing object information with performance information added thereto according to the invention. In the drawing, reference numeral 41 denotes a bus for use in circulating data among respective blocks, 42 is a CPU, 43 is a RAM, and 44 is a ROM 44. Reference numeral 45 denotes an input device such as a keyboard or mouse controller, and 46 is an external storage for use in accessing a recording medium M such as a CD-ROM, hard magnetic disk or flexible magnetic disk. Reference numeral 47 denotes a display device such as a CRT or crystal liquid panel, 48 is a sound generator, and 49 is a sound system including an amplifier, a speaker and the like. Further, reference numeral 50 denotes a MIDI interface for use in exchanging MIDI events with an external MIDI equipment, and 51 is a network interface such as a modem for use in connecting to the network.

The CPU 42 controls the entire personal computer terminal. The RAM 43 is used as a working area or buffering area, or an area in which various kinds of application programs are loaded. The ROM 44 stores various kinds of programs including a performance processing program, and various kinds of control information.

The sound generator 48 varies in configuration depending upon the sounding system adopted. If the system adopts a waveform memory type sounding system the internal memory or the ROM 44 reads waveform data stored in a recording medium M of the external storage device 46 to generate a tone signal. If the system adopts an FM sounding system, sine wave data is read from the internal waveform memory and FM-modulated to generate a music waveform. In addition to the music generating function, the sound generator 48 may have a function of adding effects such as a reverb, a chorus, a variation, and sound field localization.

The tone signal generated by the sound generator 48 is then converted into an analog waveform, amplified in the sound system 29, and emitted from the speaker. The equalizer shown in FIG. 1 is provided either inside the sounding system, or arranged before the output of the sound generator 48 is D/A converted.

The CPU 42 executes various control programs stored in the ROM 44 or RAM 43 to provide various kinds of control in response to external inputs from the input device 45, the MIDI interface 50 and the network interface 51. The CPU 42 controls the communication connection to the server, and after the completion of the connection, the CPU 42 controls the exchange of data with the server. During the music performance, the CPU 42 controls the sound generator 48 to generate a music tone through a sounding channel according to the performance information supplied from the MIDI interface 50, the network interface 51 or the external storage device 46.

It should be noted that the function of the music editing section 10 shown in FIG. 1 is carried out before a MIDI event is supplied to the sound generator. For example, if a note-on-event occurs, the CPU 42 assigns the generation of the tone to one of the sounding channels of the sound generator 48. Then, the CPU 42 supplies the assigned sounding channel with pitch information, waveform selection information, sound volume information, and the like, while the CPU 42 instructs the start of sounding the tone. Upon receipt of the instructions, the sound generator 48 uses tone waveform data read from the RAM 43 or the like according to the waveform selection information to generate a music tone signal through the sounding channel assigned.

It should be noted that the sound generator 48 can also be implemented by inserting a sound card into the personal computer terminal, or by software driven by the CPU 42.

The terminal functioning as the information reproducing apparatus is not limited to the personal computer, and the terminal may be other types of apparatuses as long as they can receive an information service on the Internet. Such apparatuses include communication equipment such as a potable telephone, a pager (beeper), a packet communication terminal, and a wire telephone with a display function, and equipment for consumer use such as a videophone, a television and a radio capable of displaying a text. The addition of the sound generator to these of equipment results in a decreased amount of transmission from the server to the terminal. The terminal may also be an electronic musical instrument with a display such as an electronic keyboard, a sound generator, a sequencer, an automatic rhythm generator and an automatic accompaniment generator.

Since digital data are exchanged between the server and the terminal, the network is not limited to the circuit switching network, and a data transmission dedicated network like a packet switching network may be employed. Taking by way of example, the public communication network through the base station 204, conversation message and audio compressed data are passed in a circuit switching mode, while the object information or digital data such as a MIDI file are handled in a packet switching mode.

Further, if a cable for a data communication card is connected to the external connection interface 205*c* of the mobile terminal 205, a personal computer terminal or PDA terminal becomes connectable. If there is no sound generator in such external equipment, the functions to be shared by the server side can be so altered that the external equipment becomes adaptable. The terminal can also be an electronic musical instrument with a display and a card interface, such as an electronic keyboard, a sound generator, a sequencer, an automatic rhythm generator and an automatic accompaniment generator.

Figure 5A:
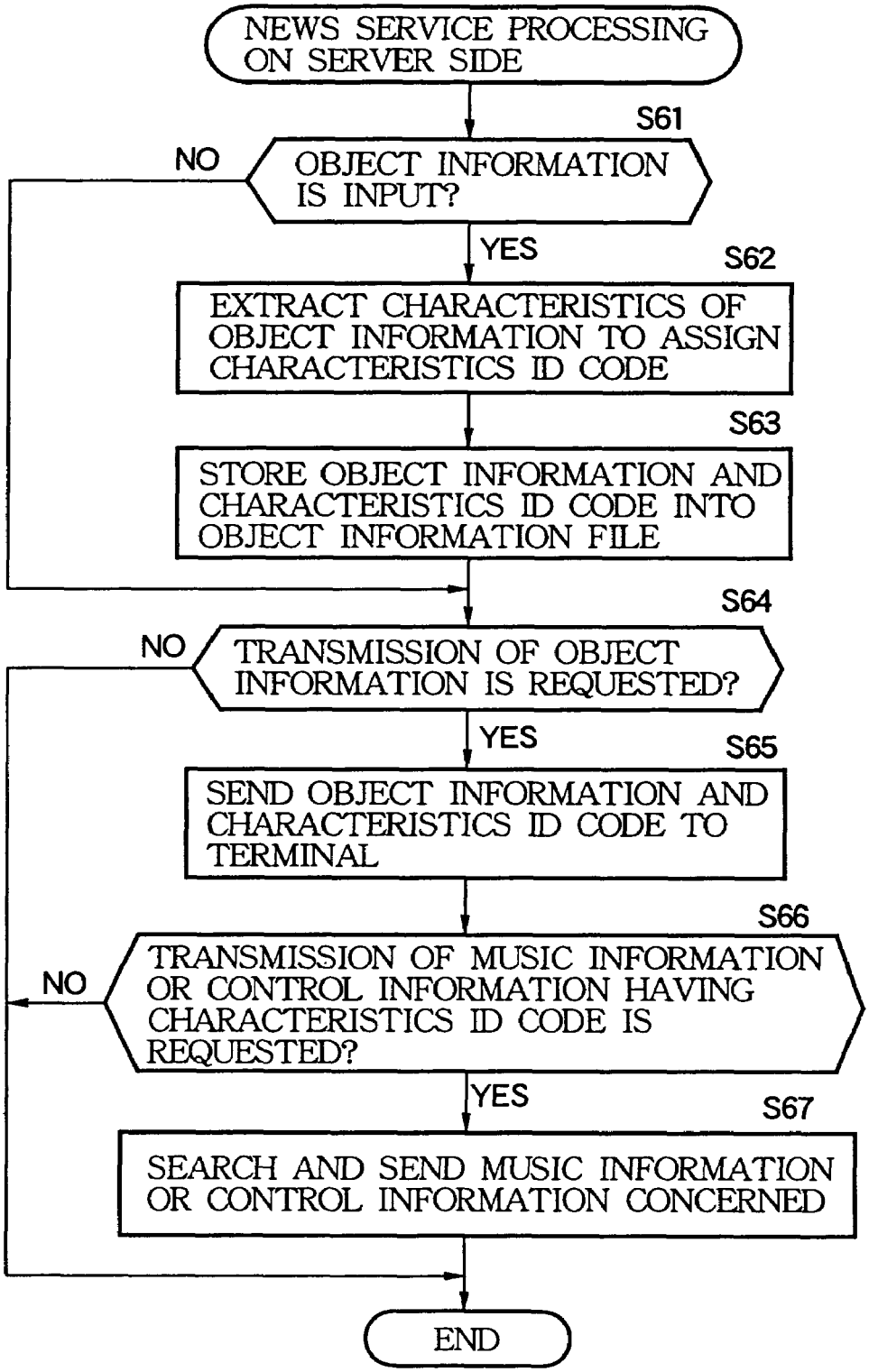
FIGS. 5A and 5B are a flowchart for explaining operations of the apparatus for creating object information with performance information added thereto as shown in FIG. 2, and the apparatus for reproducing object information with performance information added thereto as shown in FIG. 3.
Figure 5B:
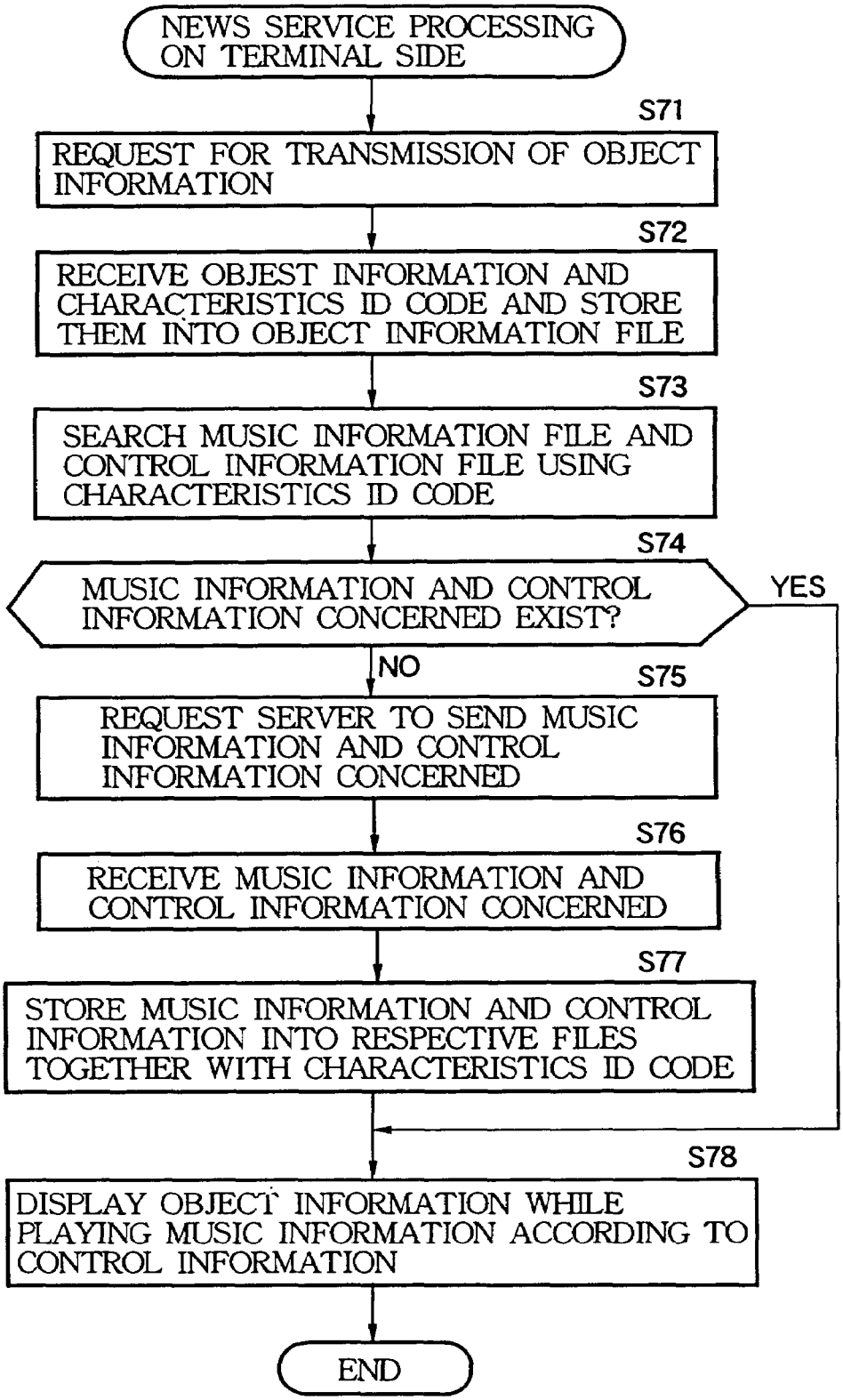

The following describes examples of operations of the information creating apparatus and the information reproducing apparatus with reference to the following flowcharts. FIGS. 5A and 5B are a flowchart for explaining operations of the apparatus for creating object information with performance information added thereto as shown in FIG. 2 and the apparatus for reproducing object information with performance information added thereto as shown in FIG. 3. This flowchart illustrates a case where the server side provides news service.

In step S61 of FIG. 5A executed by the information creating apparatus on the server side, it is determined whether or not object information is input. If the object information is input, the procedure advances to step S62, and if not input, it goes to step S64. In step S62, the characteristic extracting section 4 of FIG. 2 analyzes the object information, extracts a characteristic and assigns the object information with a characteristics ID code corresponding to the extracted characteristic. In step S63, the object information and the characteristics ID code are stored into the object information file section 1. After that, the procedure advances to step S64.

In step S64, it is determined whether or not the terminal makes a request for the transmission of the object information via the network interface 27. If the terminal makes a request for the transmission, the procedure advances to step S65, and if not, the processing is ended. In step S65, the object information and the characteristics ID code are sent to the terminal. Then, the procedure advances to step S66. In step S66, it is determined whether or not the terminal makes a request for the transmission of music information or control information having the characteristics ID code. If the terminal does not make the request, the processing is ended. If the terminal does, the search sections 23 and 25 are actuated in step S67 to search and retrieve the music information and/or the control information concerned. Then, the search sections send the outputs to the terminal, and the processing is ended.

If the user of the information reproducing apparatus on the terminal side makes a request for the reception of object information, the server is requested in step S71 of FIG. 5B to send the object information via the network interface 31. In step S72, the object information and the characteristics ID code are received and stored into the object information file section 34. In step S73, the search section 38 searches the music information file section 37 using the characteristics ID code received, and outputs the music information to which the received characteristics ID code is assigned. On the other hand, the search section 40 searches the control information file section 39 using the characteristics ID code received, and outputs the control information to which the received characteristics ID code is assigned.

In step S74, it is determined whether or not there exist such music information and control information as to be assigned the received characteristics ID code. If exist, the procedure goes to step S78, and if not, it advances to step S75. In step S75, the terminal requests the server to send the music information and the control information to which the received characteristics ID code is assigned. In step S76, the terminal receives the music information and/or the control information to which the received characteristics ID code is assigned. Then, the procedure advances to step S77.

In step S77, the music information and/or the control information, together with the received characteristics ID code, are stored into the music information file section 37 and/or the control information file section 39. In step S78, the received object information is displayed on the display monitor 9, while the music editing section 10 and the equalizer 13 are instructed to reflect the control information having the received characteristics ID code in the music information having the received characteristics ID code. The music information is output from the speaker/receiver 15, and then the processing is ended.

In the above description, if there is no such music information or control information as to correspond to the received characteristics ID code, the terminal side requests the server side to send the information.

Similarly, in the fifth embodiment that has the server sending only the object information, if the terminal side does not have a file for music information or control information corresponding to the characteristics ID code assigned to the sent object information, the terminal side may request the server side to send necessary information corresponding to the characteristics ID code. In this case, the server side searches the music information and control information corresponding to the characteristics ID code to output the same to the terminal side. The terminal side stores, together with the characteristics ID code, the sent music information and control information into a file.

Figure 6A:
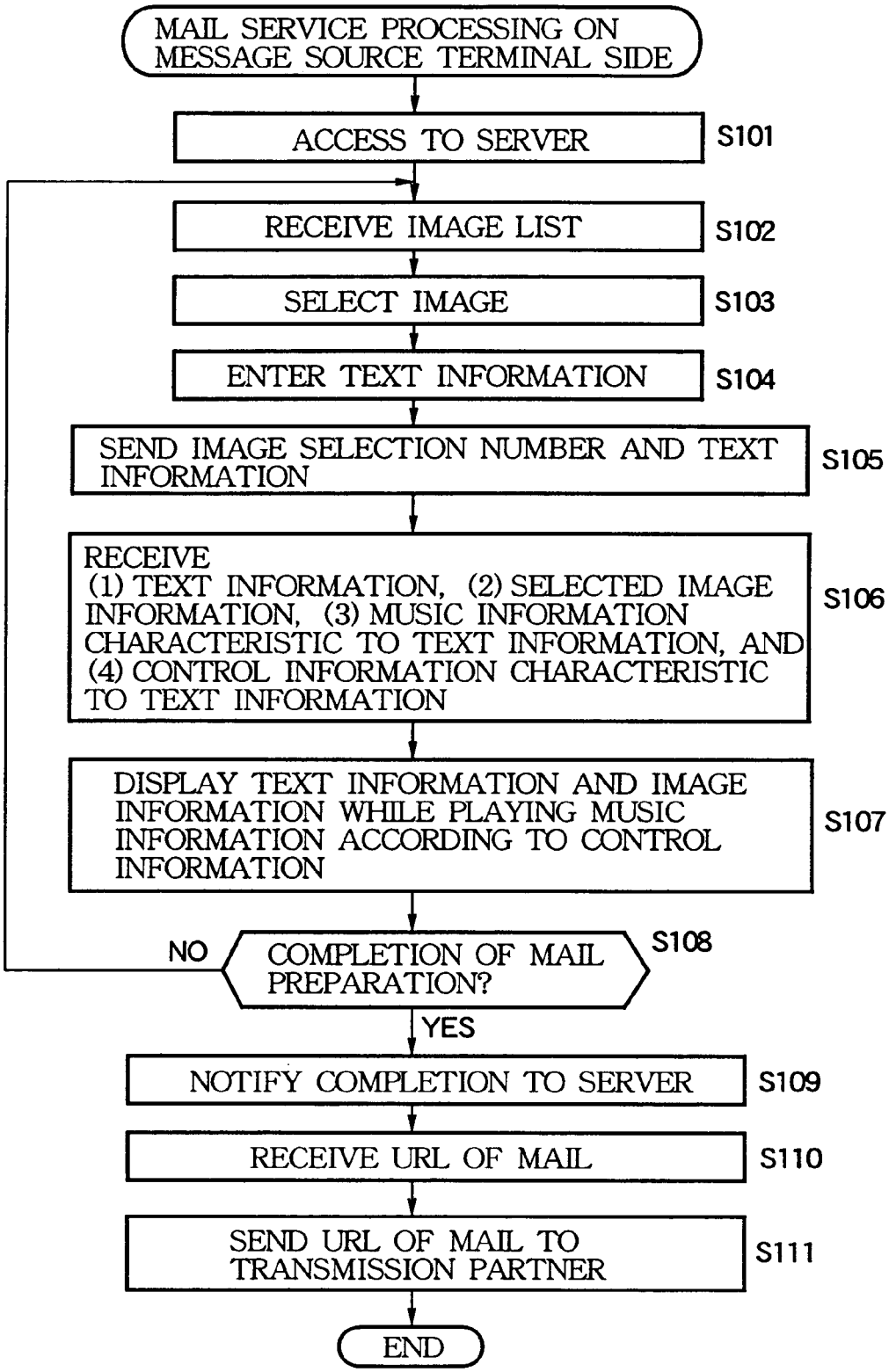
FIGS. 6A and 6B are a flowchart for explaining operations of an originating terminal and a server where the server provides mail service.
Figure 6B:
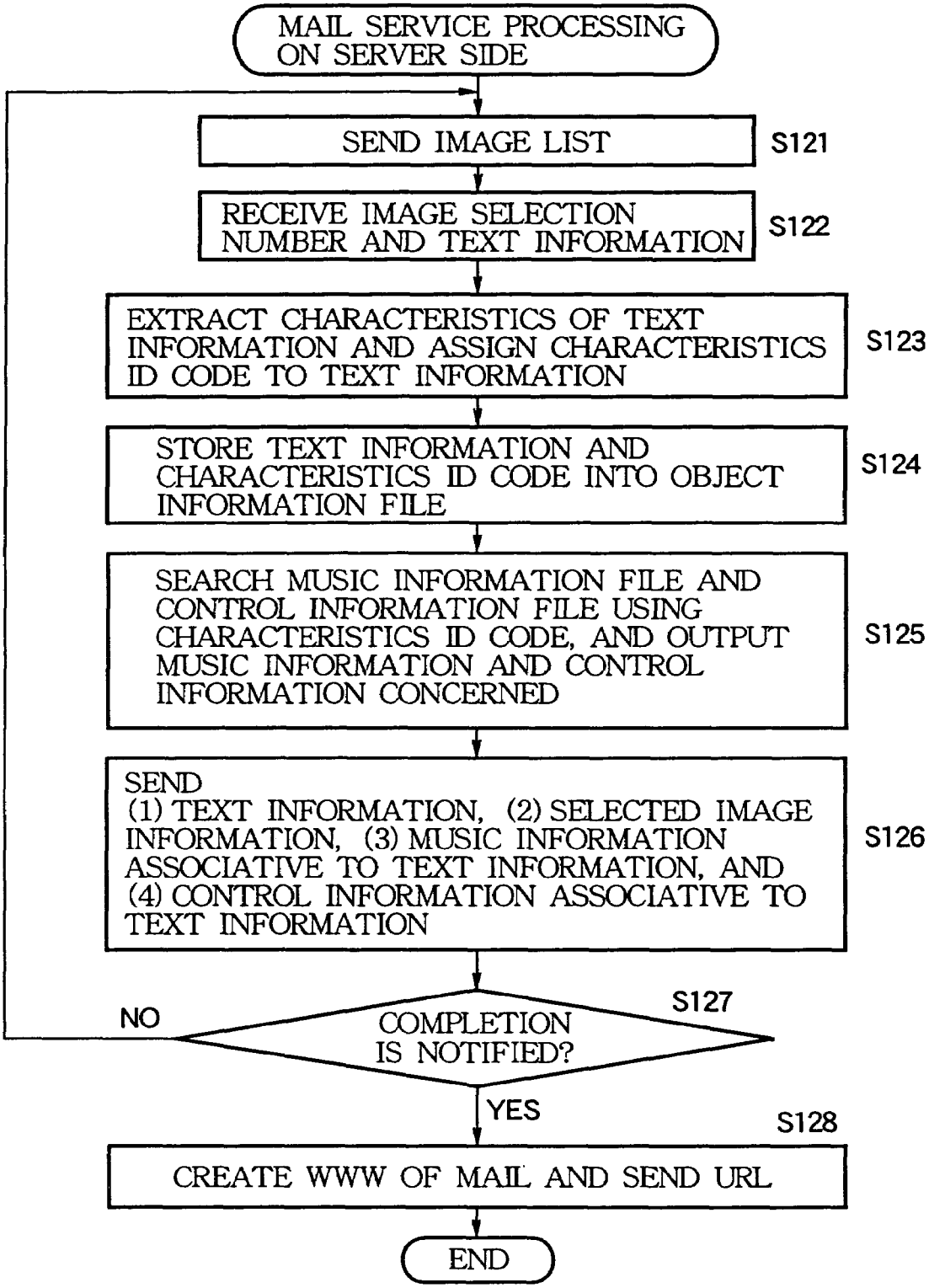

The following describes mail service operation. FIGS. 6A and 6B are is a flowchart for explaining operations of the originating terminal (e.g., the mobile terminal 205 in FIG. 11) and the server 203 where the server 203 shown in FIG. 11 provides mail service.

The following describes a case where a mail message sent from the message source terminal (e.g., the mobile terminal 205 in FIG. 11) to the destination terminal (e.g., the mobile terminal 207 in FIG. 11) through the server 203 is composed of text information and image information. It is assumed that the text information is object information, the characteristic of which is to be extracted in this processing. Namely, the information producing apparatus provides the object information having the substantial contents in the form of texts which is to be transmitted as a message by an email. In more general, the information producing apparatus the object information having the substantial contents, which are distributed through Internet.

It is also assumed that the server 203 is embodied as the first embodiment described with reference to FIG. 1. In other words, the server side sends object information, music information and control information. It should be noted, however, that FIG. 1 does not show such configurations as to store text information sent from the message source terminal into the object information file section 1, and as to store and select image information.

Further, it is assumed that the message source terminal is embodied as the first embodiment described with reference to FIG. 1. It should also be noted, however, that FIG. 1 does not show such a configuration as to send a message to the server 203. The destination terminal does not substantially differ from the terminal for use in the above-mentioned news service.

In step S101 of FIG. 6A, the message source terminal side establishes a dialup connection to the provider to access the server 203. In step S102, the source terminal receives a list of images such as illustrations from the server 203. In step S103, the user on the sender side selects an image from the list, and in step S104, he or she enters a text of his or her message through key operations. The user also enters a telephone number or mail address of the destination terminal. Then, the user sends in step S105 the server 203 the image selection number for the selected image and the text information.

In step S106, the message source terminal receives from the server 203 the following: (1) text information, (2) selected image information, (3) music information fitting the characteristic of the text information, and (4) control information fitting the characteristic of the text information.

It should be noted that if the text information is left in a buffer on the message source terminal, the message source terminal may not need to receive the text information. Then, in step S107, the message source terminal displays the text information and the image information on the display monitor 9, while the source terminal reflects the control information fitting the contents of the text information in the music information fitting the contents of the text information. After that, a music piece is played on the basis of the music information in which the control information is integrated. Thus, the user on the side of creating the text information can monitor the text information with performance information added thereto.

Thus, the information producing apparatus is constructed for producing object information containing substantial contents in combination with an identification code of the substantial contents. In the information producing apparatus, a source section provides object information having substantial contents. An acquiring section acquires an identification code indicative of a characteristic of the substantial contents of the provided object information. A generating section operates based on the acquired identification code for generating a music piece in association with the substantial contents of the provided object information, thereby evaluating whether the music piece is fit for the object information. An output section outputs the object information together with the identification code after the evaluating.

In step S108, if the user on the sender side accepts and confirms the contents of the mail created, he or she will push a creation completion button to proceed with the procedure. If the user wants to work over the creation, he or she will push a re-creation button to return the procedure to step S102. Then, in step S109, the server is informed of the completion of the creation. The created mail is stored on the server side in the form of, for example, a WWW (World Wide Web) page.

In step S110, the message source terminal is informed from the server 203 of the URL (Uniform Resource Locator) of the WWW page. In step S111, the user on the sender side sends the destination terminal a conventional type of mail to inform the destination terminal of the above-mentioned URL.

The destination terminal receives the mail and recognizes the URL. If the user of the destination terminal accesses the URL, he or she can receive the information identical to the information received at the message source terminal. Then, like in step S107, the user of the destination terminal can observe the display of the text information and the image information on the display, while he or she can listen to the performance of the music information with the control information reflected therein.

On the other hand, in step S121 of FIG. 6B on the side of the server 203, the server 203 sends the message source terminal the list of images when the message source terminal makes a request for the service. In step S122, the server 203 receives the image selection number and the text information.

In step S123, the server 203 extracts the characteristic of the text information in the characteristic extracting section 4 shown in FIG. 1, and assigns a characteristics ID code to the text information. In step S124, the server 203 stores the text information and the characteristics ID code into the object information file section 1. In step S125, the search section 23 uses the characteristics ID code to retrieve, from the music information file section 2, music information to which the characteristics ID code is assigned. Then, the search section 23 outputs the retrieved music information.

On the other hand, the search section 25 uses the characteristics ID code to retrieve, from the control information file section 3, control information to which the characteristics ID code is assigned. Then, the search section 25 outputs the retrieved control information.

In step S126, the server 203 sends the message source terminal four kinds of information as shown in step S106. If the server 203 receives in step S127 a notification of the completion of the mail creation, the procedure advances to step S128, and if not, the procedure returns to step S121. In step S128, the server 203 creates a WWW page for the mail and sends the URL of the WWW page to the message source terminal.

It should be noted that a mode may be so provided that the user of the message source terminal can select any music information from two or more music lists, regardless of the characteristic of the text information. Further, either the music information or the control information may be selected according to the characteristic of the text information. Of course, the image information is not necessarily involved in the mail service.

The WWW page to be sent to the destination terminal does not need to be completed at the mail creation. The WWW page may be created when the destination terminal accesses the URL. In this case, the text information and the characteristics ID code are read from the object information file section 1, and on the basis of the characteristics ID code, the music information file and the control information file are read out to create the WWW page. Further, the server side may automatically make a notification of the URL to the destination terminal.

In the above description, the apparatuses are operated as those in the first embodiment described with reference to FIG. 1, but the apparatuses may be operated as those in any other embodiments. Further, in steps S106 and S126, the characteristics ID code may be sent from the server to the terminal instead of the information (3) and (4) of step S106.

Furthermore, if the user on the message source terminal side can assign a characteristics ID code to the text information beforehand, the user may enter the characteristics ID code together with the text information to send both to the server side. In this case, the server side can use the characteristics ID code as it is to retrieve the music information and/or the control information of the music information.

Figure 7:
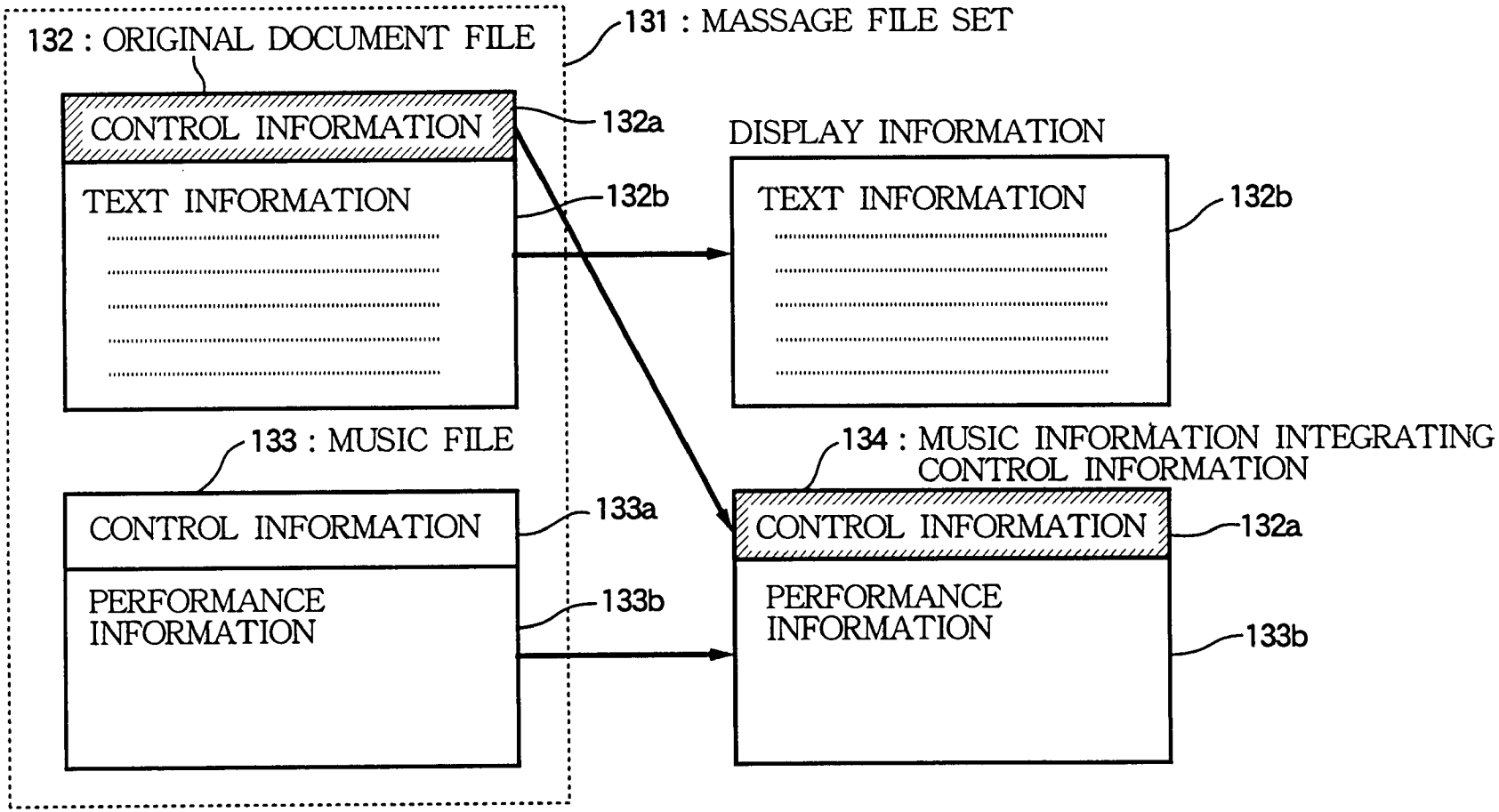
FIG. 7 is a diagram of a first example of a message file set.

Referring to FIGS. 7 through 10, the following describes file formats to be sent from the server side to the terminal side. FIG. 7 is a diagram for explaining a first example of a message file set. In the drawing, reference numeral 131 denotes a message file set, 132 is an original document file, 132*a* is a setup measure template, and 132*b* is a text information part. Reference numeral 133 denotes a music file, 133*a* is a setup measure part, 133*b* is a song body part, and 134 is a music information integrating control information.

The message file set 131 consists of the original document file 132 and the music file 133, and is created in the network interface on the server side. In this example, the control information for use in controlling the style of performance is embedded in the object information file. The music file 133 is provided aside from the original document file 132. The original document file 132 is an original document file for news or messages.

The music file 133 may be an SMF or another type of file that conforms to the standard. The original document file 132 has the setup measure template 132*a* at the head of the text information 132*b*. The template 132*a* contains a prescription of control information. The initialization or default setting status of the control information, which originally accompanies each piece of music, is also prescribed in the setup measure part 133*a*. Note data of the music and control information to be inserted during performance are then prescribed in the song body part 133*b*.

The terminal side receives the above-mentioned message file set 131 and displays the text information 132*a* on the display monitor 9 as display information. Then, the terminal side replaces the setup measure part 133*a* of the music file 133 with the setup measure template 132*a*, which results in the creation of the music information 134 in which the control information inserted in the original document file 132 is reflected into the music information.

It should be noted that all the information including tone control information contained in the setup measure part 133*a* of the music file 133 is not necessarily replaced.

The above-mentioned message file set 132 may be written in a format exclusively used in the apparatus concerned, but it can be written in a simple format such as the HTML (Hypertext Mark-up Language) or like language. For example, the control information 132*a* and the music file 133 are made into files with an extension "mid", and sent together with the text information 132*b* in which such an "ENBED" or "OBJECT" tag as to describe the link destination of each "mid" file is inserted.

The terminal side reads the MIDI file and rewrites the setup measure part 133*a* using the setup measure template 132*a* as a patch file. The music information 134 in which the control information is thus reflected is reproduced and played. The music file 133 may be played automatically after all the information is downloaded, or after the line is turned off. It can also be reproduced in an on-line streaming mode during reception.

If an image information file, not shown, is to be added to the message file set 131, such a tag as to describe the image file name may be inserted in the original document file 132 while sending the image file as a separate file.

Figure 8:
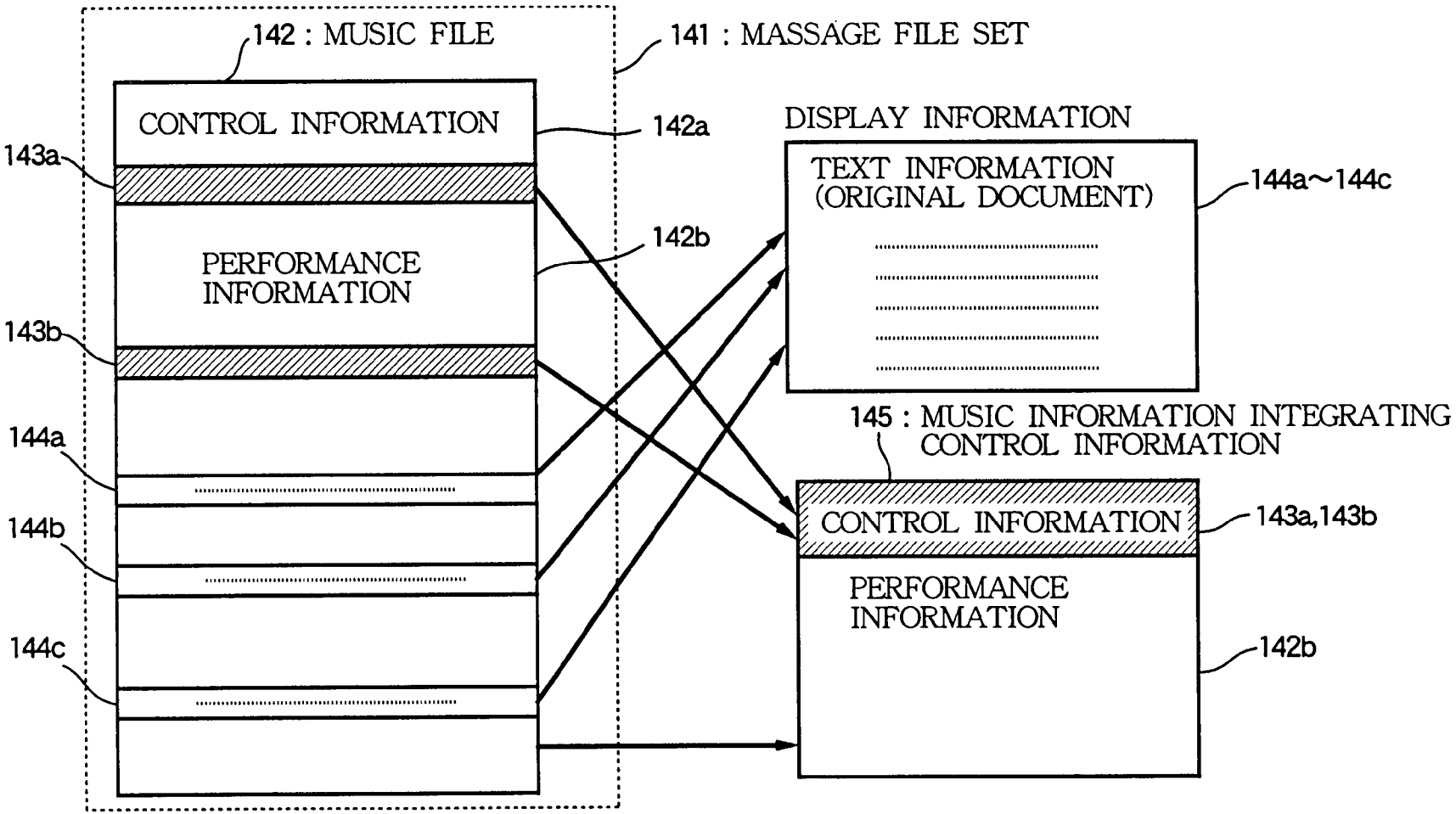
FIG. 8 is a diagram of a second example of a message file set.

FIG. 8 is a diagram for explaining a second example of a message file set. In the drawing, reference numeral 141 denotes a message file set, 142 is a music file, 142*a* is a setup measure part, and 142*b* is a song body part. Reference numerals 143*a* and 143*b* denote two or more divided setup templates containing control information. Reference numerals 144*a*, 144*b* and 144*c* denote text information divided into two or more parts, and 145 is music information integrating control information.

In this example, the message file set 141 is a file in which the original text information is separately embedded in the music file 142; it is created in the network interface of the server.

In the SMF, a character string of information associated with the copyright and lyrics of the music concerned can be inserted in the file as a meta event. Therefore, the setup measure templates 143*a* and 143*b* can be embedded in the same manner as the template 132*a* shown in FIG. 7. Further, the text information indicated by reference numeral 132*a* in FIG. 7 can also be inserted as those indicated by reference numerals 144*a* through 144*c*.

The terminal side gathers the text information 144*a* through 144*c* to display the gathered text information on the display monitor 9 as display information. Then, the terminal side replaces the setup measure part 142*a* of the music file 142 with the setup measure templates 143*a* and 143*b*, which results in the creation of the music information 145 with the control information reflected therein. The created music information 145 is then played.

In the above-mentioned example, the template of the control information and the text information are inserted in the music file in the form of a meta event distinguishable from performance information. Alternatively, a technique for inserting a watermark in the music file can be so employed that the above-mentioned text information can be inserted in the music file. For example, the use of the least significant byte in two or more kinds of key velocity information existing in the performance information allows insertion of the text information.

In reverse, data of the music file may be inserted in the original document file or MPEG image file, not shown, which may be sent together with the original document file. The insertion may be carried out by the watermark technique to insert a watermark into the text information or the image file.

Even when the music file 133 is not sent from the server side to the terminal side, the original document file 132 can be created in the same manner. Further, if a characteristics ID code is to be sent from the server side, the ID code can be sent in the same manner as the above-mentioned control information 132*a*, or as watermarked information.

Figure 9:
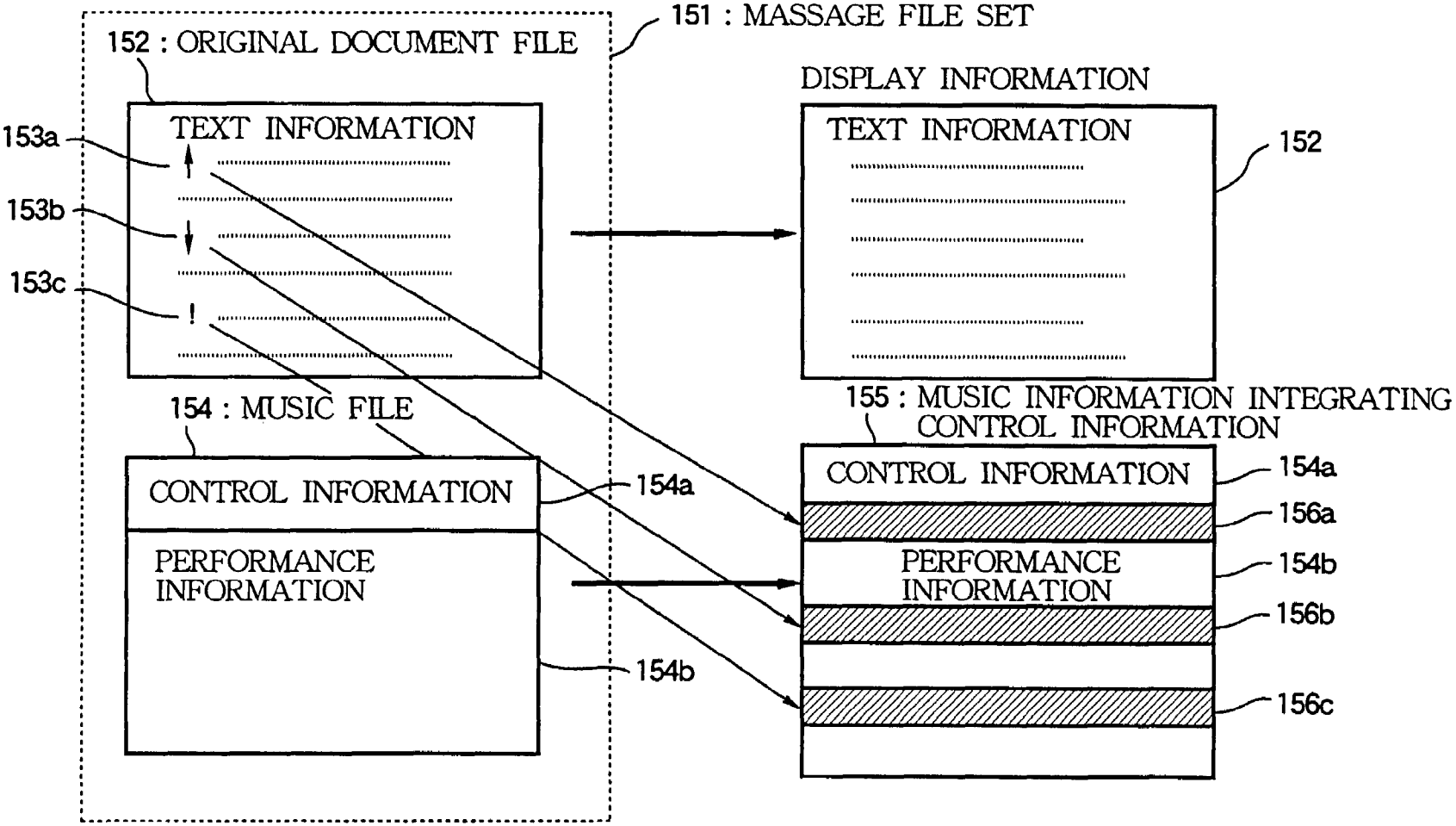
FIG. 9 is a diagram of a third example of a message file set.

FIG. 9 is a diagram for explaining a third example of a message file set. In the drawing, reference numeral 151 denotes a message file set, 152 is an original document file, 153*a* through 153*c* represent symbols corresponding to respective characteristics ID codes. Reference numeral 154 denotes a music file, 154*a* is a setup measure part, and 154*b* is a song body part. Reference numeral 155 denotes music information integrating control information, and 156*a* through 156*c* are pieces of control information.

To make clear the features of the message file set, it is assumed that, although the original document file contains two or more different contents, a piece of music continues to be used as the music file 154 without changing the music during performance.

The symbols 153*a* through 153*c* corresponding to the characteristics ID codes are inserted at the head of each part differently in contents of the original document file 152. The symbols used as corresponding to the characteristics ID codes are given a correspondence to the characteristic information. These symbols must be allowed as expression elements of the text information. Namely, in the information producing apparatus, the attaching section attaches the identification code in the form of a symbol code selected from a standard code set for information interchange such as JIS code or ASCII in correspondence to the extracted characteristic information representative of a mental impression of the substantial contents.

The terminal side at which the above-mentioned message file set 151 is received displays the text information 152 on the display monitor 9 as display information. The symbols 153*a* through 153*c* corresponding to the characteristics ID codes are excluded from the display information to avoid their obstacle presence, but they may be displayed if desired.

On the other hand, the music information 155 with the control information reflected therein is created as follows: First, the music is controlled basically by the control information existing in the setup measure part 154*a* of the music file 154. Then, the symbols 153*a* through 153*c* corresponding to the characteristics ID codes are detected from the original document file 152. On the basis of the symbols, the pieces of control information 156*a* through 156*c* are retrieved from the control information file 3 shown in FIG. 3, as the pieces of control information corresponding to the characteristics ID codes. The retrieved pieces of control information are then output.

The symbol "↑" indicated by reference numeral 153*a* as corresponding to one of the characteristics ID codes represents the following commands: one command is to increase the tempo relatively to 120% of the value preset in the setup measure part 154*a*. Another command is to set the sound volume relatively to 120% of the value preset in the setup measure part 154*a*. A further command is to arrange music to be a major if the key of the music is a minor. The control information 156*a* corresponding to this symbol is then inserted into the song body part 154*b* of the music information 155.

The symbol "↓" indicated by reference numeral 153*b* as corresponding to another characteristics ID code represents the following commands: one command is to reduce the tempo relatively to 60% of the reference value. Another command is to reduce the sound volume relatively to 70% of the value preset in the setup measure part 154*a*. A still another command is to arrange music to be a minor if the key of the music is a major. The control information 156*b* corresponding to this symbol is then inserted into the song body part 154*b* of the music information 155.

The symbol "!" indicated by reference numeral 153*c* as corresponding to still another characteristics ID code is to command that a sound of emergency or similar sound effect of a short phrase be inserted and reproduced. The control information 156*c* corresponding to this symbol (in this case, the symbol is to command the sound generator to output waveform data of the sound effect of a single phrase) is then inserted into the song body part 154*b* of the music information 155.

Such expression elements like the symbols 153*a* through 153*c* corresponding to the characteristics ID codes are not limited to special symbols, and they may be any characters. Further, such symbols may be inserted at the time of creation of an original document, or the symbols 153*a* through 153*c* corresponding to the characteristics ID codes may be automatically inserted after characteristics are extracted from the original document and their characteristics ID codes are output.

It should be noted that if the symbols are to be inserted at the time of creation of original document, the server side can extract these symbols to search for music information or control information. Therefore, the server side can also create the music information 155 with the control information reflected therein, and output the same as the message file set.

In the example shown, there is no change in the music file itself, but a variation may be made to the music file. For example, the symbol "↑" indicated by reference numeral 153*a* corresponding to one of the characteristics ID codes selects a piece of music in a major, while the symbol "↓" indicated by reference numeral 153*b* corresponding to another characteristics ID code selects a piece of music in a minor.

Suppose further that the display information is displayed by line scrolling or automatic page switching. In this case, each piece of the control information 156*a* through 156*c* is inserted in such a time position as to correspond to the start position of each content in the original document file 152. Consequently, the performance of the music carried out under the control of the control information can be synchronized with timing at which the head of each news is displayed.

Figure 10:
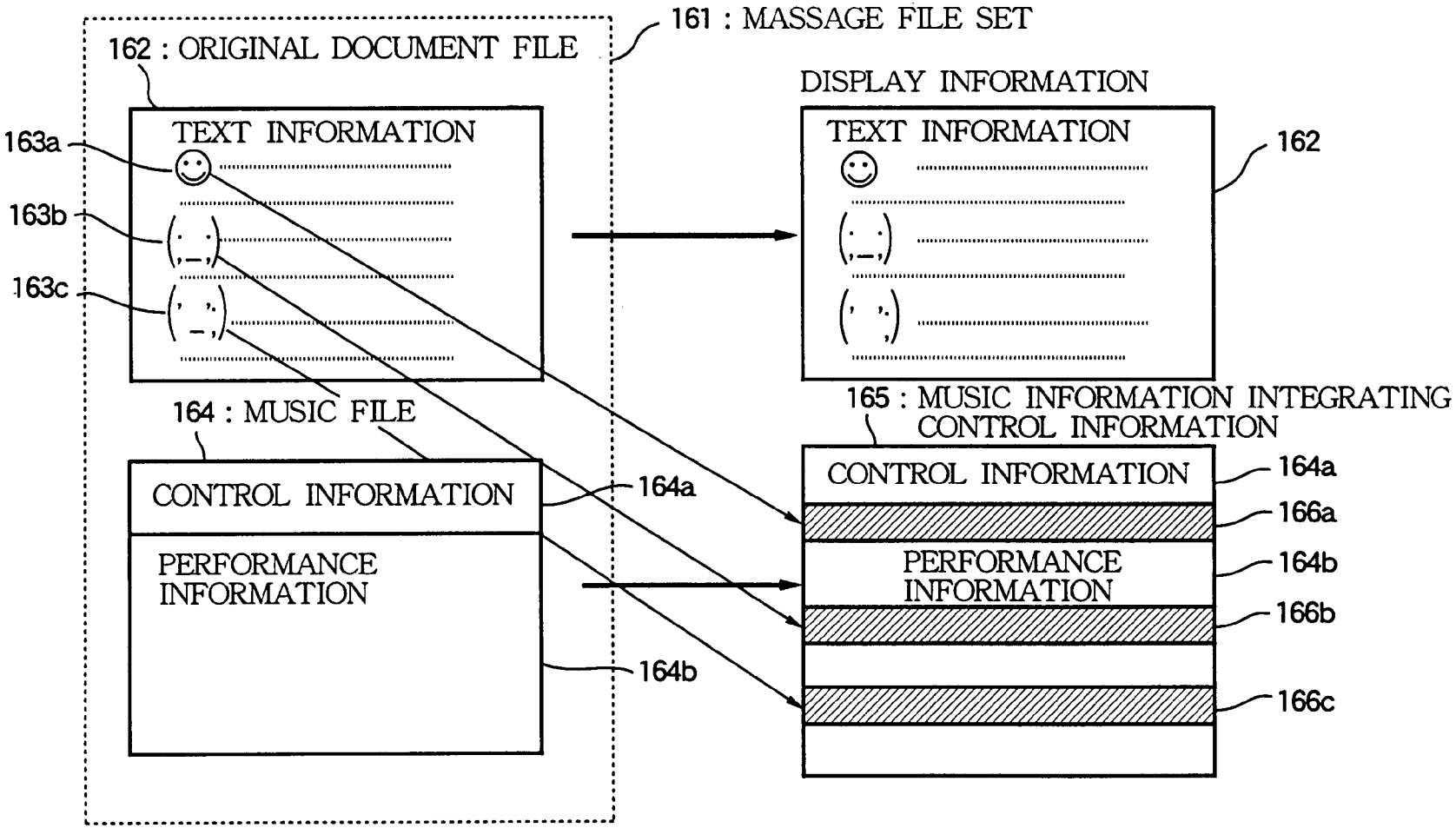
FIG. 10 is a diagram of a fourth example of a message file set.

FIG. 10 is a diagram for explaining a fourth example of a message file set. In the drawing, reference numeral 161 denotes a message file set, 162 is an original document file, 163*a* through 163*c* are face marks corresponding to respective characteristics ID codes. Reference numeral 164 denotes a music file, 164*a* is a setup measure part, 164*b* is a song body part, 165 is music information integrating control information, and 166*a* through 166*c* are pieces of control information.

In this example, although the original document also contains two or more contents, it is assumed that the music file 164 is not changed during performance.

The marks 163*a* through 163*c* corresponding to the characteristics ID codes are inserted at the head of each item of the original document file 162. The marks 163a through 163*c* are special symbols to express or suggest human sensibilities or feelings, typified by the symbol 163*a*, or similar face marks 163*b* and 163*c* created from a combination of plural kinds of symbols or characters. Such symbols may be inserted at the time of creation of an original document, or the face marks 163*a* through 163*c* corresponding to the characteristics ID codes may be automatically inserted after characteristics are extracted from the original document and their characteristics ID codes are output.

It should be noted that if the symbols 163*a* through 163 corresponding to the above-mentioned ID codes are to be inserted at the time of creation of an original document, the server side can extract these symbols to search for music information or control information. Therefore, the server side can also create the music information 165 with the control information reflected therein and output the same as the message file set. The terminal side at which the above-mentioned message file set 161 is received displays the text information 162 including the face marks 163*a* through 163*c* on the display monitor 9 as display information.

As described above, the information producing apparatus or the server attaches the identification code in the form of a symbol selected in correspondence to the characteristic information to represent a mental impression of the substantial contents. For example, the information producing apparatus attaches the identification code in the form of a face mark selected in correspondence to the extracted characteristic information to represent a mental impression derived from the substantial contents.

The face symbol indicated by reference numeral 163a corresponding to one of the characteristics ID codes is to control music, as representing a feeling of "pleasure," in the same manner as the symbol 153*a* corresponding to the characteristics ID code shown in FIG. 9. The control information 166*a* corresponding to this face symbol is inserted into the song body 164*b* of the music information 165.

The face mark "(;_;)" indicated by reference numeral 163*b* corresponding to another characteristics ID code is to control music, as representing a feeling of "sadness," in the same manner as the symbol 153*b* corresponding to the characteristics ID code shown in FIG. 9. The control information 166*b* corresponding to this face mark is inserted into the song body 164*b* of the music information 165.

The face mark "('_';)" indicated by reference numeral 163*c* corresponding to still another characteristics ID code is to control music, as representing a feeling of "surprise," in the same manner as the symbol 153*c* corresponding to the characteristics ID code shown in FIG. 9. The control information 166*c* corresponding to this face mark is inserted into the song body 164*b* of the music information 165. Also in this example, if the display information is displayed while being scrolled, the performance of the music carried out under the control of the control information can be synchronized with timing at which the head of each text item is displayed.

In the above description, the text information is illustrated as the object information, but image information such as static image information and dynamic image information can be used as the object information, from which the characteristic such as to express or suggest a human sensibility or feeling is extracted. In this case, specific color or the shape of an icon like one of the above-mentioned face marks can be used as corresponding to a characteristics ID code to perform a music piece using music information and/or control information having the characteristics ID code.

It should be noted that, as similar to the music information, background color of an area on which the text information is displayed, or color of the frame part of the area may also be controlled to correspond to the characteristics ID code obtained from the text information.

In the above description, for the sake of simplicity, the same characteristics ID code is used for both the internal search in the information creating apparatus and the information reproducing apparatus, and the exchange of characteristic information between the information creating apparatus and the information reproducing apparatus. However, different formats or code systems of the characteristics ID code representing a piece of characteristic information can be used for the internal search and the exchange of characteristic information, respectively.

Further, in the above description, the apparatuses automatically carry out the characteristics extraction and the search of music information and/or control information having the characteristic information. However, the person in charge on the server side or the user on the terminal side may carry out such operations manually with the assistance of the apparatus side.

Furthermore, various kinds of embodiments are described in various cases where information distribution service is provided between the server and the terminal. However, the information reproducing apparatus may not be provided with communication means. Even in this case, the information reproducing apparatus can display the object information by inputting the object information into the system shown in FIG. 1, as well as reproduction of music information for such a performance as to fit the characteristic of the object information.

Furthermore, the object information, the characteristics ID code and the like, to be output from the information creating apparatus, may be recorded on a recording medium. In other words, the information creating apparatus can concurrently hold both functions as an information transmitting apparatus and an information recording apparatus.

On the other hand, the information reproducing apparatus can read the object information, the characteristics ID code and the like, as recorded on the recording medium, to display the object information as well as reproduction of music information for a performance. In other words, the information reproducing apparatus can concurrently hold both functions as an information receiving/reproducing apparatus and an information reading/reproducing apparatus for reading information from the recording medium.

Such an apparatus is suitable for use in a recording/reproducing apparatus capable of reproduction of such a performance as to fit the characteristic of the object information.

As apparent from the above description, the invention can not only enhance the expressive effect of music performance on the object information, but also inform the user of the outline of the object information in a short time, thereby adding value to information distribution.

If the characteristic information is output from the creation apparatus side to the reproduction apparatus side, the creation and detection of the characteristic information can be made easier.

Further, the object information allows the performance information to be automatically added, which results in such an efficient music performance as to fit the object information distributed.

What is claimed is:

1. An information producing apparatus for producing object information having substantial contents in combination with an identification code of the substantial contents, the information producing apparatus comprising:

a source section that provides the object information having substantial contents;

an extracting section that analyzes the provided object information to extract therefrom characteristic information which is characteristic of the substantial contents of the provided object information; and an attaching section that attaches an identification code to the provided object information in correspondence to the extracted characteristic information such that the identification code indicates a characteristic of the substantial contents of the provided object information wherein said identification code has also previously been assigned to music information as well as to control information adapted to control the style of reproducing said music information.

2. The information producing apparatus according to claim 1, further comprising an output section that outputs the provided object information together with the attached identification code.

3. The information producing apparatus according to claim 1, wherein the source section provides the object information having the substantial contents in the form of texts which is to be transmitted as a message by an email.

4. The information producing apparatus according to claim 1, wherein the source section provides the object information having the substantial contents, which are distributed through Internet.

5. The information producing apparatus according to claim 1, wherein the attaching section attaches the identification code in the form of a symbol code selected from a standard code set for information interchange in correspondence to the extracted characteristic information representative of a mental impression of the substantial contents.

6. The information producing apparatus according to claim 1, wherein the attaching section attaches the identification code in the form of a symbol selected in correspondence to the extracted characteristic information to represent a mental impression of the substantial contents.

7. The information producing apparatus according to claim 1, wherein the attaching section attaches the identification code in the form of a face mark selected in correspondence to the extracted characteristic information to represent a mental impression derived from the substantial contents.

8. The information producing apparatus according to claim 1, wherein the extracting section analyzes the provided object information to extract therefrom the characteristic information in the form of a keyword which is contained in texts of the object information.

9. The information producing apparatus according to claim 8, wherein the extracting section extracts the keyword which indicates a mental impression derived from the substantial contents of the object information.

10. The information producing apparatus according to claim 1, wherein the extracting section analyzes the provided object information to extract therefrom the characteristic information in the form of a brightness of an image which is contained in the object information.

11. The information producing apparatus according to claim 1, wherein the extracting section analyzes the provided object information to extract therefrom the characteristic information in the form of a color tone of an image which is contained in the object information.

12. The information producing apparatus according to claim 1, wherein the source section provides the object information having the substantial contents in the fOrm of texts.

13. The information producing apparatus according to claim 1, wherein the source section provides the object information having the substantial contents in the form of graphics.

14. The information producing apparatus according to claim 1, wherein the source section provides the object information having the substantial contents in the form of videos.

15. An information reproducing apparatus for reproducing performance information to provide a music piece in association with substantial contents of object information, the information reproducing apparatus comprising:

a receiving section that receives object information having substantial contents together with an identification code which indicates a characteristic of the substantial contents of the object information; and a reproducing section that operates based on the identification code so as to reproduce performance information for providing a performance of a music piece in association with the substantial contents of the received object information, the music piece being selected according to the identification code, wherein the reproducing section includes an editing section operative based on the identification code for editing music information which is contained in the performance information and which is representative of the music piece such that the music piece is modified in association with the substantial contents of the object information.

16. The information reproducing apparatus according to claim 15, wherein the reproducing section further reproduces the substantial contents of the received object information.

17. The information reproducing apparatus according to claim 15, wherein the editing section edits the music information to modify a sound equalizing of the music piece in association with the substantial contents of the object information.

18. The information reproducing apparatus according to claim 15, wherein the editing section edits the music information to modify a style of the performance of the music piece in association with the substantial contents of the object information.

19. The information reproducing apparatus according to claim 18, wherein the editing section modifies the style of the performance of the music piece in terms of a music scale of the music piece.

20. The information reproducing apparatus according to claim 18, wherein the editing section modifies the style of the performance of the music piece in terms of a rhythm or a tempo of the music piece.

21. The information reproducing apparatus according to claim 15, wherein the receiving section receives the object information having the substantial contents in the form of texts which is transmitted as a message by an email.

22. The information reproducing apparatus according to claim 15, wherein the receiving section receives the object information having the substantial contents which are distributed through Internet.

23. An information reproducing apparatus for reproducing music information to provide a performance of a music piece in association with substantial contents of object information, the information reproducing apparatus comprising:

a receiving section that receives object information having substantial contents together with an identification code which indicates a characteristic of the substantial contents of the object information;

a searching section that operates according to the identification code for searching control information effective to control the performance of the music piece; and a reproducing section that reproduces the music information for providing the performance of the music piece while controlling the performance of the music piece according to the searched control information in association with the substantial contents of the received object information.

24. An information reproducing method of reproducing performance information to provide a music piece in association with substantial contents of object information, the information reproducing method comprising the steps of:

receiving object information having substantial contents together with an identification code which indicates a characteristic of the substantial contents of the object information; and reproducing the performance information based on the identification code to provide a performance of a music piece in association with the substantial contents of the received object information, the music piece being selected according to the identification code, wherein the step of reproducing includes editing, based on the identification code, music information which is contained in the performance information and which is representative of the music piece such that the music piece is modified in association with the substantial contents of the object information.

25. An information reproducing method of reproducing music information to provide a performance of a music piece in association with substantial contents of object information, the information reproducing method comprising the steps of:

receiving object information having substantial contents together with an identification code which indicates a characteristic of the substantial contents of the object information;

searching control information according to the identificatjon code, the control information being effective to control the performance of the music piece; and reproducing the music information to provide the performance of the music piece while controlling the performance of the music piece according to the searched control information in association with the substantial contents of the received object information.

26. A machine readable medium for use in an information reproducing apparatus having a CPU for reproducing performance information to provide a music piece in association with substantial contents of object information, the medium containing program instructions executable by the CPU for causing the information reproducing apparatus to carry out a. process comprising the steps of:

receiying object information having substantial contents together with an identification code which indicates a characteristic of the substantial contents of the object information; and reproducing the performance information based on the identification code to provide a performance of a music piece in association with the substantial contents of the received object information, the music piece being selected according to the identification code, wherein the step of reproducing includes editing, based on the identification code, music information which is contained in the performance information and which is representative of the music piece such that the music piece is modified in association with the substantial contents of the object information.

27. A machine readable medium for use in an information reproducing apparatus having a CPU for reproducing music information to provide a performance of a music piece in association with substantial contents of object information, the medium containing program instructions executable by the CPU for causing the information reproducing apparatus to carry out a process comprising the steps of:

receiving object informatjon having substantial contents together with an identification code which indicates a characteristic of the substantial contents of the object information;

searching control information according to the identification code, the control information being effective to control the performance of the music piece; and reproducing the music information to provide the performance of the music piece while controlling the performance of the music piece according to the searched control information in association with the substantial contents of the received object information.

* * * * *